US011466653B2

(12) United States Patent
Yanoto

(10) Patent No.: US 11,466,653 B2
(45) Date of Patent: Oct. 11, 2022

(54) CONTROL DEVICE FOR FUEL INJECTION VALVE AND FUEL INJECTION SYSTEM

(71) Applicant: DENSO CORPORATION, Kariya (JP)

(72) Inventor: Keisuke Yanoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/104,784

(22) Filed: Nov. 25, 2020

(65) Prior Publication Data

US 2021/0079878 A1 Mar. 18, 2021

Related U.S. Application Data

(63) Continuation of application No. PCT/JP2019/020636, filed on May 24, 2019.

(30) Foreign Application Priority Data

May 31, 2018 (JP) ..... JP2018-105546

(51) Int. Cl.
*F02D 41/20* (2006.01)
*F02M 63/02* (2006.01)
*F02M 63/00* (2006.01)

(52) U.S. Cl.
CPC ..... *F02M 63/0225* (2013.01); *F02D 41/20* (2013.01); *F02D 2041/201* (2013.01);
(Continued)

(58) Field of Classification Search
CPC ..... F02D 2041/2003; F02D 2041/2006; F02D 2041/201; F02D 2041/2013;
(Continued)

(56) References Cited

U.S. PATENT DOCUMENTS 5,992,391 A * 11/1999 Yamakado ..... F02D 41/20 123/490
6,571,773 B1 * 6/2003 Yamakado ..... F02D 41/20 123/486

(Continued)

FOREIGN PATENT DOCUMENTS

| | | | |
|---|---|---|---|
| JP | 06-241137 | * | 8/1994 |
| JP | 10-47140 | | 2/1998 |
| JP | 2014-98375 | | 5/2014 |
| JP | 2016-196893 | | 11/2016 |

*Primary Examiner* — Erick R Solis

(74) *Attorney, Agent, or Firm* — Nixon & Vanderhye P.C.

(57) ABSTRACT

A control device controls a drive current that flows through a drive coil of a fuel injection valve that is electromagnetically driven. A control device includes a determination unit configured to determine whether a supply fuel pressure, which is a pressure of fuel supplied to the fuel injection valve, is higher than a determination pressure at which the fuel pressure is determined abnormally high; a first control unit configured to control the drive current in a first mode when the determination unit determines that the supply fuel pressure is not higher than the determination pressure; and a second control unit configured to control the drive current in a second mode that facilitates maintaining of the fuel injection valve in an open state more than in the first mode when the determination unit determines that the supply fuel pressure is higher than the determination pressure.

18 Claims, 15 Drawing Sheets

(52) U.S. Cl.
CPC ..... *F02D 2041/2003* (2013.01); *F02D 2041/2006* (2013.01); *F02D 2041/2013* (2013.01); *F02D 2041/2017* (2013.01); *F02D 2041/2027* (2013.01); *F02D 2041/2055* (2013.01); *F02D 2041/2058* (2013.01); *F02D 2200/0602* (2013.01); *F02M 63/0017* (2013.01)

(58) Field of Classification Search
CPC ..... F02D 2041/2017; F02D 2041/2027; F02D 2041/2058; F02D 2200/0602; F02D 2200/0604
USPC ..... 123/479, 490
See application file for complete search history.

(56) References Cited

U.S. PATENT DOCUMENTS

| | | | | |
|---|---|---|---|---|
| 7,305,971 | B2 * | 12/2007 | Fujii | F02D 41/3836 123/479 |
| 2002/0000761 | A1 * | 1/2002 | Rueger | F02D 41/2096 310/316.01 |
| 2004/0040545 | A1 * | 3/2004 | Nasu | F02D 41/3836 123/490 |
| 2010/0145597 | A1 * | 6/2010 | Keegan | F02D 41/0085 701/106 |
| 2017/0226951 | A1 | 8/2017 | Yanoto | |
| 2020/0049092 | A1 * | 2/2020 | Stutika | F02D 41/20 |
| 2021/0293194 | A1 * | 9/2021 | Stutika | F02D 41/20 |

* cited by examiner

CONTROL DEVICE FOR FUEL INJECTION VALVE AND FUEL INJECTION SYSTEM

CROSS REFERENCE TO RELATED APPLICATION

The present application is a continuation application of International Patent Application No. PCT/JP2019/020636 filed on May 24, 2019, which designated the U.S. and claims the benefit of priority from Japanese Patent Application No. 2018-105546 filed on May 31, 2018. The entire disclosures of all of the above applications are incorporated herein by reference.

TECHNICAL FIELD

The present disclosure relates to a control device that controls a fuel injection valve.

BACKGROUND

Conventionally, an internal combustion engine is provide with a fuel injection valve to inject fuel.

SUMMARY

According to an aspect of the present disclosure, a control device is configured to control a drive current that flows through a drive coil of a fuel injection valve that is electromagnetically driven. The control device includes a determination unit configured to determine whether a supply fuel pressure, which is a pressure of fuel supplied to the fuel injection valve, is higher than a determination pressure at which the fuel pressure is determined abnormally high. The control device further includes a first control unit configured to control the drive current in a first mode when the determination unit determines that the supply fuel pressure is not higher than the determination pressure. The control device further includes a second control unit configured to control the drive current in a second mode that facilitates the fuel injection valve to maintain in an open state more than in the first mode, when the determination unit determines that the supply fuel pressure is higher than the determination pressure.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
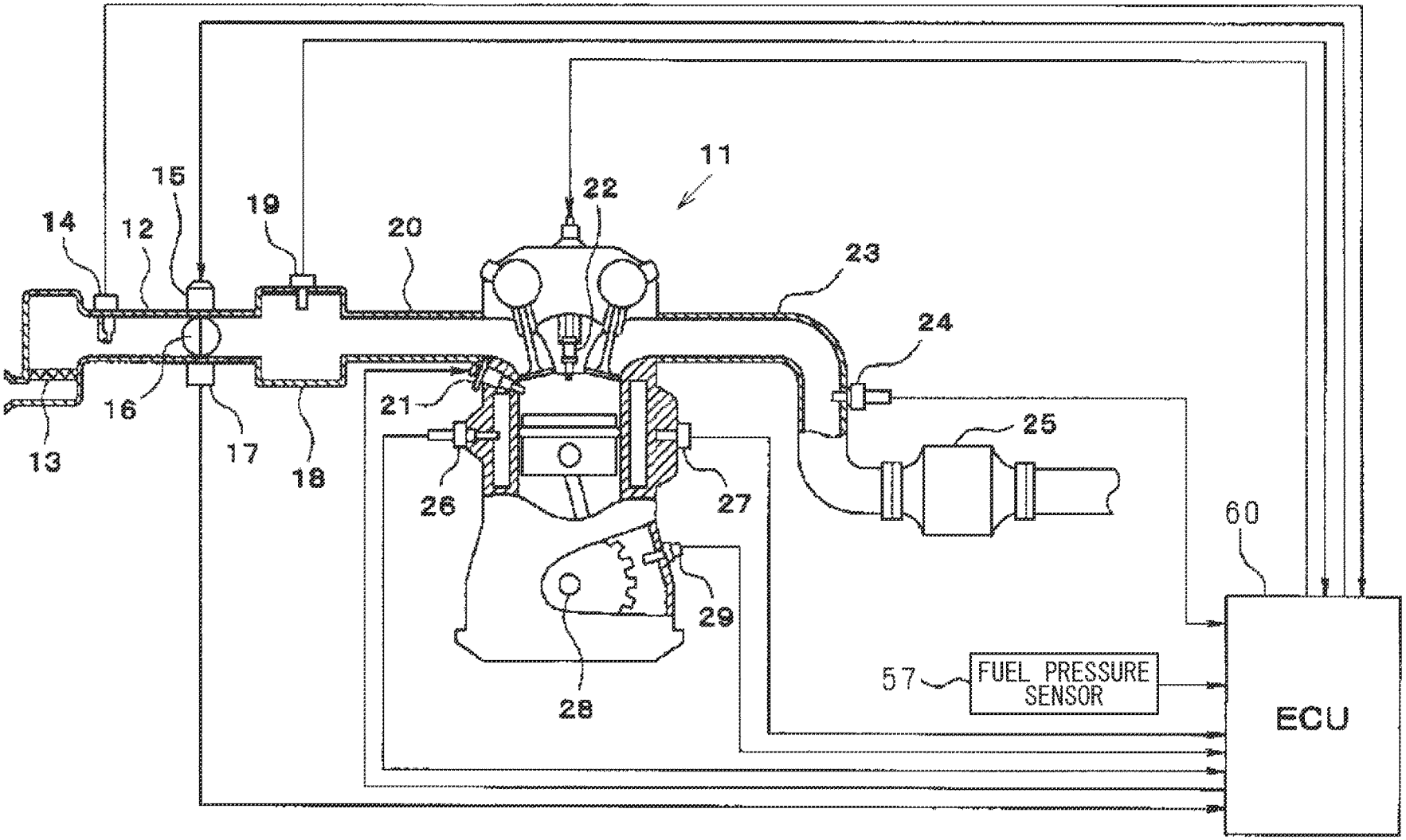
FIG. 1 is a schematic diagram showing an overview of an engine and a fuel injection system.

As follow, examples of the present disclosure will be described. According to an example of the present disclosure, a control device applies a high voltage to a drive coil of an electromagnetically driven fuel injection valve to quickly raise a drive current to a target peak current and thereafter to apply a low voltage intermittently to the drive coil to maintain the drive current at a hold current.

It is noted that, in order to cause the fuel injection valve to inject fuel, the drive coil may generally require a large drive current to path therethrough, as the pressure of fuel supplied to the fuel injection valve (hereinafter referred to as "supply fuel pressure") becomes higher. Therefore, in a case where the supply fuel pressure increases excessively due to an abnormality caused in the fuel pump or the like, fuel may not be injected with the fuel injection valve even when the drive current is raised to the target peak current.

According to an example of the present disclosure, a control device is configured to control a drive current that flows through a drive coil of a fuel injection valve that is electromagnetically driven. The control device includes a determination unit configured to determine whether a supply fuel pressure, which is a pressure of fuel supplied to the fuel injection valve, is higher than a determination pressure at which the fuel pressure is determined abnormally high; a first control unit configured to control the drive current in a first mode when the determination unit determines that the supply fuel pressure is not higher than the determination pressure; and a second control unit configured to control the drive current in a second mode that facilitates the fuel injection valve to maintain in an open state more than in the first mode, when the determination unit determines that the supply fuel pressure is higher than the determination pressure.

According to the above configuration, the drive current that flows through the drive coil of the fuel injection valve that is electromagnetically driven is controlled by the control device. Herein, it is determined by the determination unit whether or not the supply fuel pressure, which is the pressure of fuel supplied to the fuel injection valve, is higher than the determination pressure that is for determining that the fuel pressure is abnormally high. In addition, in a case where it is determined that the supply fuel pressure is not higher than the determination pressure, the drive current is controlled by the first control unit in the first mode. Alternatively, in a case where it is determined that the supply fuel pressure is higher than the determination pressure, the drive current is controlled by the second control unit in the second mode that facilitates to maintain the open state of the fuel injection valve more than the first current pattern. Therefore, even when the supply fuel pressure is higher than the determination pressure, the configuration enables the fuel injection valve to perform fuel injection. Generally, power consumption in the second mode is larger than power consumption in the first mode. In this respect, when the supply fuel pressure is not higher than the determination pressure, that is, when the supply fuel pressure is normal, the drive current is controlled in the first mode. Therefore, the configuration enables to suppress increase in power consumption.

According to an example of the present disclosure, the determination pressure is a pressure at which the fuel injection valve is incapable of injecting fuel when the drive current is controlled in the first mode.

According to the above-described configuration, when the supply fuel pressure becomes higher than the determination pressure and when the drive current is controlled in the first mode, the fuel injection valve cannot inject fuel. In that case, the configuration controls the drive current in the second mode thereby to enable to cause the fuel injection valve to inject fuel.

According to an example of the present disclosure, the determination pressure is a pressure at which the fuel injection valve is incapable of being in a fully open state when the drive current is controlled in the first mode.

According to the above-described configuration, when the supply fuel pressure becomes higher than the determination pressure and when the drive current is controlled in the first mode, the fuel injection valve cannot be in the fully open state. In that case, the configuration controls the drive current in the second mode thereby to enable to fully open the fuel injection valve to inject fuel.

As a fuel injection valve that is configured to inject fuel at a higher supply fuel pressure, there is a core boost type fuel injection valve that moves a valve body by using a core after accelerating and moving the core with the electromagnetic force generated by using the drive coil. In the core boost fuel injection valve, the drive current required to move the core and the valve body becomes larger than the drive current required to move only the core. Therefore, the valve body cannot be moved to the fully open position unless the drive current, when the core and the valve body are moved, is larger than a predetermined current.

In this respect, according to an example of the present disclosure, a voltage applied to the drive coil when the drive current is increased to a maximum value in an injection period in the second mode is higher than a voltage applied to the drive coil when the drive current is increased to a maximum value in an injection period in the first mode. Therefore, in a case in which the control device is applied to the core boost type fuel injection valve, the configuration facilitates to increase the drive current to be larger than a predetermined current when moving the valve body. Therefore, the configuration enables to cause the fuel injection valve to inject fuel at a higher supply fuel pressure. It is noted that, the maximum value of the drive current in the first mode and the maximum value of the drive current in the second mode may be the same as each other or may be different from each other.

According to an example of the present disclosure, the second mode includes a control to continuously maintain the drive current after increasing the drive current to a maximum value in an injection period and a control to reduce the drive current from the maximum value to a hold value in the injection period and to maintain the drive current.

According to the above configuration, when the drive current is controlled in the second mode, the drive current is continuously maintained after being increased to the maximum value in the injection period. Therefore, the configuration enables to continuously maintain the electromagnetic force generated by using the drive coil after increasing the electromagnetic force to the maximum value. In addition, the configuration enables to facilitate to open the fuel injection valve and to maintain the fuel injection valve in the open state. Further, the configuration reduces the drive current from the maximum value to the hold value and holds the drive current. Therefore, the configuration enables to suppress the power consumption when the fuel injection valve is maintained in the open state.

According to an example of the present disclosure, the first mode includes a control to increase the drive current to the maximum value in the injection period and subsequently to continuously decrease the drive current to the hold value and to maintain the drive current, and the maximum value of the drive current in the injection period in the second mode is larger than the maximum value of the drive current in the injection period in the first mode.

According to the above configuration, when the drive current is controlled in the first mode, the drive current is continuously maintained after being increased to the maximum value in the injection period and being reduced to the hold value.

To the contrary, when the drive current is controlled in the second mode, the drive current is maintained at the maximum value that is larger than the maximum value of the drive current in the injection period in the first mode. Therefore, the configuration enables to facilitate to maintain the fuel injection valve in the open state in the mode as compared with the first mode.

According to an example of the present disclosure, the first mode includes a control to increase the drive current to the maximum value in the injection period and subsequently to continuously decrease the drive current to the hold value and to maintain the drive current, and the maximum value of the drive current in the injection period in the second mode is smaller than the maximum value of the drive current in the injection period in the first mode.

According to the above configuration, when the drive current is controlled in the first mode, the drive current is continuously maintained after being increased to the maximum value in the injection period and being reduced to the hold value. To the contrary, when the drive current is controlled in the second mode, the drive current is maintained at the maximum value that is smaller than the maximum value of the drive current in the injection period in the first mode. That is, even in a case in which the maximum value of the drive current in the injection period in the second mode is smaller than the maximum value of the drive current in the injection period in the first mode, the configuration maintains the drive current continuously after increasing the drive current to the maximum value in the injection period, thereby to facilitate to maintain the open state of the fuel injection valve. Therefore, the configuration enables to facilitate to maintain the fuel injection valve in the open state and to suppress increase in power consumption.

Herein, the higher the rotation speed of an engine that is provided with the fuel injection valve, the shorter the interval between the fuel injection and the fuel injection. For this reason, heat caused by the control device tends to accumulate when maintaining the drive current at the maximum value. Therefore, temperature of the control device may exceed the heat resistant temperature.

In this respect, according to an example of the present disclosure, the second control unit is configured to set a period, in which the second control unit maintains the drive current continuously after increasing the drive current to the maximum value in the injection period, such that the period becomes shorter, as a rotation speed of the engine, to which the fuel injection valve is mounted, becomes higher. Therefore, the configuration enables to restrict the temperature of the control device from exceeding the heat resistant temperature even when the rotation speed of the engine that is provided with the fuel injection valve increases.

In a case where the supply fuel pressure is high, even when the fuel injection valve is once in the open state, the fuel injection valve may return to the close state until the fuel injection valve is stabilized in the open state.

In this respect, according to an example of the present disclosure, the second control unit is configured to set a period, in which the second control unit maintains the drive current continuously after increasing the drive current to the maximum value in the injection period, to a period until the fuel injection valve is stabilized in the open state. Therefore, in a case where the drive current is controlled in the second mode, the configuration enables to increase the drive current to the maximum value in the injection period and subsequently to maintain the drive current at the maximum value until the fuel injection valve is stabilized in the open state. Thus, even when the supply fuel pressure increases excessively, the configuration enables to cause the fuel injection valve to perform stable fuel injection. The period until the fuel injection valve is stabilized in the open state may be acquired in advance based on an experiment or the like.

In a case where the period, in which the drive current is continuously controlled in the second mode, becomes excessively long, the temperature of the control device may exceed the heat resistant temperature.

In this respect, according to an example of the present disclosure, the second control unit is configured to change the drive current in the second mode to the drive current in the first mode when the period in which the second control unit controls the drive current continuously in the second mode becomes longer than a predetermined period. Therefore, when the temperature of the control device increases due to controlling of the drive current in the second mode continuously, the control device changes the drive current to be in the first mode thereby to enable to suppress the increase in temperature of the control device. In this respect, according to an example of the present disclosure, the second control unit is configured to change the drive current in the second mode to the drive current in the first mode when the supply fuel pressure becomes equal to or lower than the determination pressure.

According to the above configuration, when the supply fuel pressure becomes equal to or lower than the determination pressure, the drive current in the second mode is changed to the drive current in the first mode. Therefore, the configuration enables to suppress the drive current from being controlled in the second mode more than as required thereby to suppress the increase in temperature of the control device and to suppress the increase in power consumption.

According to an example of the present disclosure, the first mode includes a control to apply a voltage, which is in a direction to reduce the drive current, to the drive coil, after increasing the drive current to a maximum value in an injection period, and the second mode does not include the control to apply the voltage, which is in the direction to reduce the drive current, to the drive coil, after increasing the drive current to a maximum value in an injection period.

According to the above configuration, when the drive current is controlled in the first mode, the drive current is increased to the maximum value in the injection period, and subsequently, the voltage in the direction to reduce the drive current is applied to the drive coil. This configuration enables to suppress noise caused when the fuel injection valve becomes to be in the full open state. To the contrary, when the drive current is controlled in the second mode, the drive current is increased to the maximum value in the injection period, and subsequently, the voltage in the direction to reduce the drive current is not applied to the drive coil. Therefore, when the supply fuel pressure increases excessively, the configuration enables to prioritize the ease of maintaining the open state of the fuel injection valve rather than suppressing noise.

An embodiment of a fuel injection system applied to an engine mounted to a vehicle will be described below with reference to the drawings.

First, an outline of a configuration of an engine 11 will be described with reference to FIG. 1.

An air cleaner 13 is provided at the most upstream portion of an intake pipe 12 of the engine 11 that is of an in-cylinder injection type. An air flow meter 14 is provided at a downstream of the air cleaner 13 for detecting an intake air amount. A throttle valve 16 whose opening is adjusted by using a motor 15 and a throttle opening sensor 17 which detects the opening degree (throttle opening degree) of the throttle valve 16 are provided on the downstream side of the air flow meter 14.

A surge tank 18 is provided on the downstream side of the throttle valve 16. The surge tank 18 is provided with an intake pipe pressure sensor 19 that detects an intake pipe pressure. The surge tank 18 is provided with an intake manifold 20 that conducts air into each cylinder of the engine 11. Each cylinder of the engine 11 is provided with a fuel injection valve 21 that directly injects fuel into the cylinder. An ignition plug 22 is attached to each cylinder head of the engine 11. The ignition plug 22 in each cylinder causes spark discharge to ignite air-fuel mixture in each cylinder.

An exhaust pipe 23 of the engine 11 is provided with an exhaust gas sensor 24 (air-fuel ratio sensor, oxygen sensor, or the like) that detects an air-fuel ratio or a rich/lean state of exhaust gas. A catalyst 25 such as a three-way catalyst for purifying exhaust gas is provided on the downstream side of the exhaust gas sensor 24.

A coolant water temperature sensor 26 for detecting a coolant water temperature and a knock sensor 27 for detecting knocking are attached to a cylinder block of the engine 11. A crank angle sensor 29 that outputs a pulse signal each time a crank shaft 28 rotates by a predetermined crank angle is attached to the outer peripheral side of the crank shaft 28. The crank angle and the engine speed are detected based on an output signal of the crank angle sensor 29. A fuel supply system (for example, a delivery pipe) that supplies fuel to the fuel injection valve 21 is provided with a fuel pressure sensor 57 that detects a pressure (supply fuel pressure) of fuel supplied to the fuel injection valve 21. Fuel is pressure-fed to the delivery pipe by using a fuel pump (not shown).

The output signals of these various sensors are inputted to an electronic control unit (hereinafter referred to as "ECU") 60. The ECU 60 (control device for the fuel injection valve) mainly includes a microcomputer and executes various engine control programs stored in a ROM (storage medium) to control the supply pressure, the fuel injection amount, the ignition timing, the throttle opening (intake air amount), and the like according to the engine operating state. The fuel injection system is formed with the fuel injection valve 21, the fuel pressure sensor 57, and the ECU 60. The detailed configuration of the ECU 60 will be described later.

Next, the outline of the configuration of the fuel injection valve 21 will be described with reference to FIGS. 2 to 5.

Figure 2:
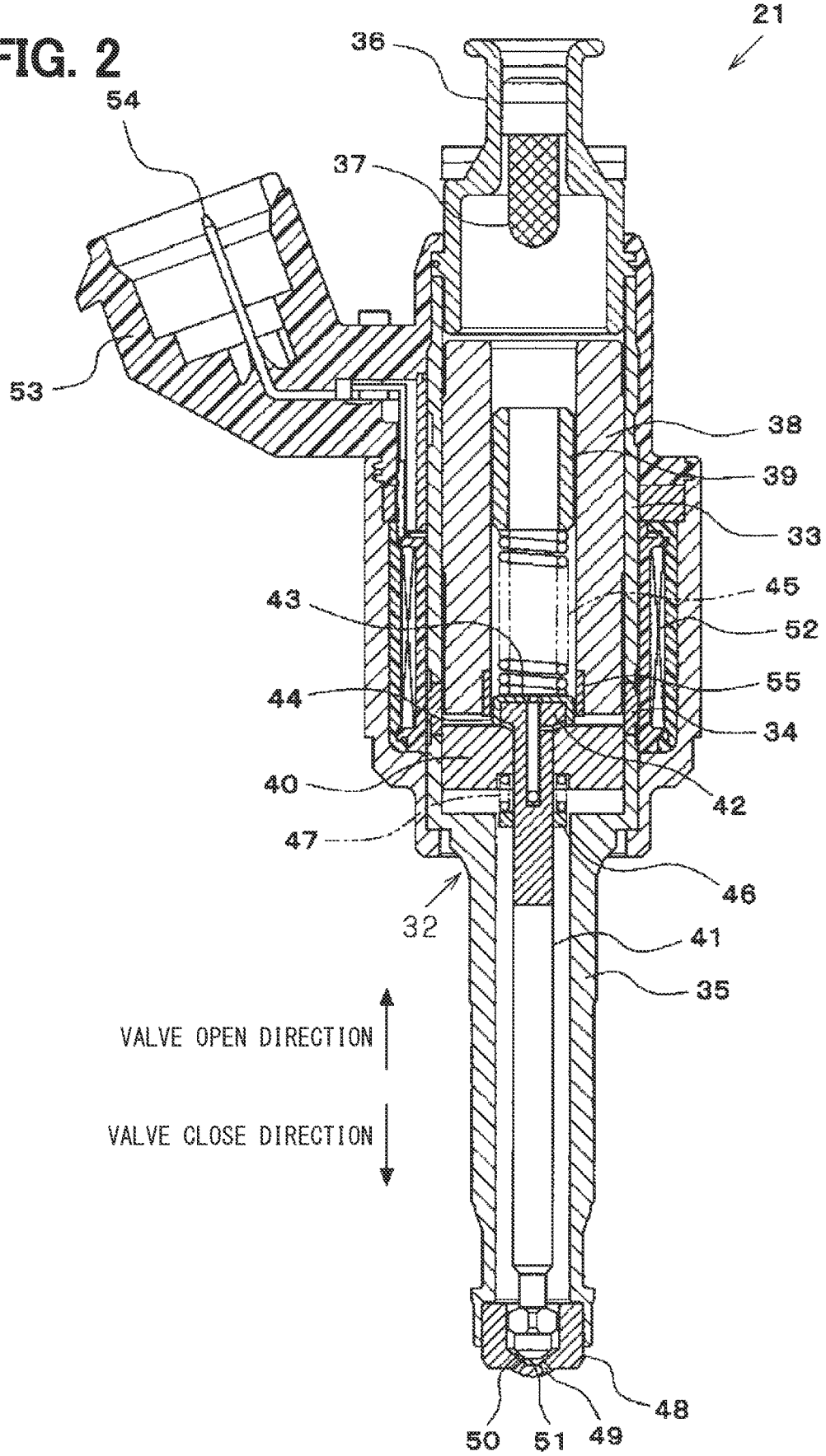
FIG. 2 is a cross-sectional view showing the fuel injection device.

As shown in FIG. 2, a main body housing 32 of the fuel injection valve 21 is formed by connecting a third tubular member 35 to a lower end portion of a first tubular member 33 via a second tubular member 34. The first tubular member 33 and the third tubular member 35 are formed of a magnetic material. The second tubular member 34 is formed of a non-magnetic material. A fuel connector portion 36 is connected to an upper end portion of the main body housing 32 (upper end portion of the first tubular member 33) that is connected to a delivery pipe (not shown). A fuel filter 37 that filters fuel is attached to the radially inner side of the fuel connector portion 36.

A cylindrical fixed core 38 formed of a magnetic material is provided on the radially inner side of the main body housing 32. A tubular adjuster 39 is provided on the radially inner side of the fixed core 38. A tubular movable core 40 that is formed of a magnetic material is provided on the lower side of the fixed core 38 to be movable in open/close directions (vertical direction in FIGS. 2 to 5). The movable core 40 is provided as a separate component from a needle 41 that opens and closes injection holes 49. The needle 41 is movably inserted in the open and close directions on the radially inner side of the movable core 40.

Figure 3:
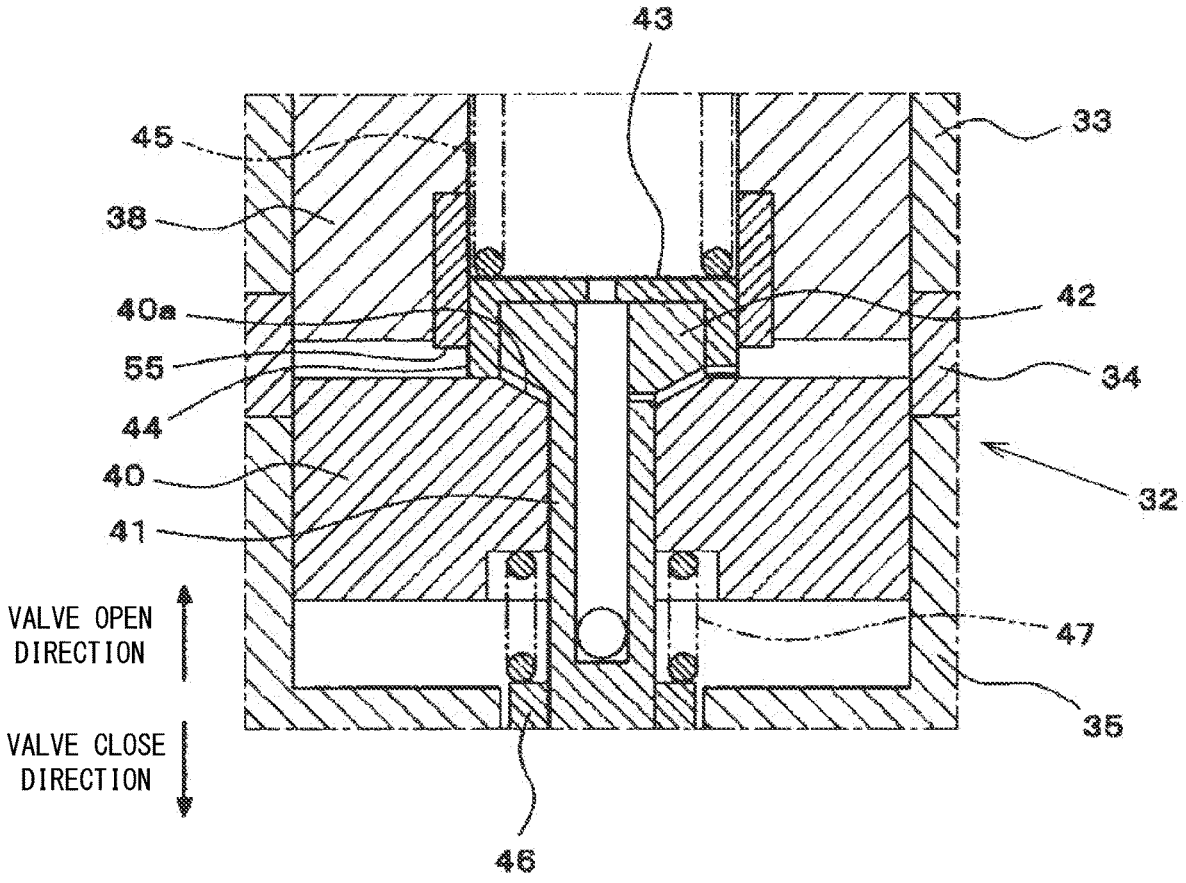
FIG. 3 is an enlarged cross-sectional view showing a state of the fuel injection valve when not energized.

As shown in FIG. 3, a collar portion 42 having an outer diameter larger than the inner diameter of the movable core 40 is provided at the upper end of the needle 41. The flange 42 protrudes above the movable core 40. A tapered portion 40*a* (pressing portion) formed on the upper surface of the movable core 40 comes into contact with the lower surface of the collar portion 42 (pressed portion) of the needle 41, so that the movable core 40 opens the needle 41 in the valve open direction (in the upper direction in FIGS. 2 to 5).

On the upper side of the needle 41, a bottomed tubular cup 43 is provided so as to be movable in the opening/close directions while covering the collar portion 42 of the needle 41. An outer peripheral wall 44 of the cup 43 is in contact with the upper surface of the movable core 40 (the radially outer side of the tapered portion 40*a*). The depth of the outer peripheral wall 44 of the cup 43 is set to be larger than the height of the collar portion 42 of the needle 41.

A first spring 45, which is a biasing member, is provided between the cup 43 and the adjuster 39 (see FIG. 2). The first spring 45 biases the cup 43 in the valve closing direction (downward in FIGS. 2 to 5) thereby to urge the needle 41 and the movable core 40 in the valve closing direction. A ring member 46 is fixed to the outer peripheral surface of the needle 41 on the lower side of the movable core 40. A second spring 47 is provided between the ring member 46 and the movable core 40. The movable core 40 is biased in the valve open direction by the second spring 47. The resilient force (biasing force) of the second spring 47 is set to be smaller than the resilient force (biasing force) of the first spring 45.

As shown in FIG. 2, a nozzle portion 48 is provided at the lower end portion of the main body housing 32 (the lower end portion of the third tubular member 35). Multiple injection holes 49 are formed in the nozzle portion 48. When a valve body 50 at the lower end (tip) of the needle 41 is separated (lifted) from a valve seat 51 of the nozzle portion 48, the injection hole 49 is opened, and fuel is injected. When the valve body 50 is abutted (seated) on the valve seat 51, the injection holes 49 are closed, and fuel injection is stopped.

A solenoid 52 (driving coil) that drives the movable core 40 in the valve open direction is arranged on the radially outer side of the main body housing 32. A terminal 54 connected to the solenoid 52 is provided inside a connector 53 that is provided above the solenoid 52.

As shown in FIG. 3, when the solenoid 52 is not energized, the cup 43 is moved in the valve closing direction by application of the resilient force of the first spring 45. As a result, the needle 41 and the movable core 40 are pushed by the cup 43 to move in the valve closing direction, and the fuel injection valve 21 is closed (injection holes 49 are closed). At this time, the valve body 50 of the needle 41 makes contact with the valve seat 51, whereby the lower limit position of the needle 41 is regulated, and this lower limit position becomes the valve close position of the needle 41. As described above, the depth of the outer peripheral wall 44 of the cup 43 is set to be larger than the height of the collar portion 42 of the needle 41. Therefore, the fuel injection valve 21 has a configuration (so-called core boost configuration) in which a predetermined gap is formed between the tapered portion 40*a* of the movable core 40 and the collar portion 42 of the needle 41 when the solenoid 52 is not energized.

Figure 4:
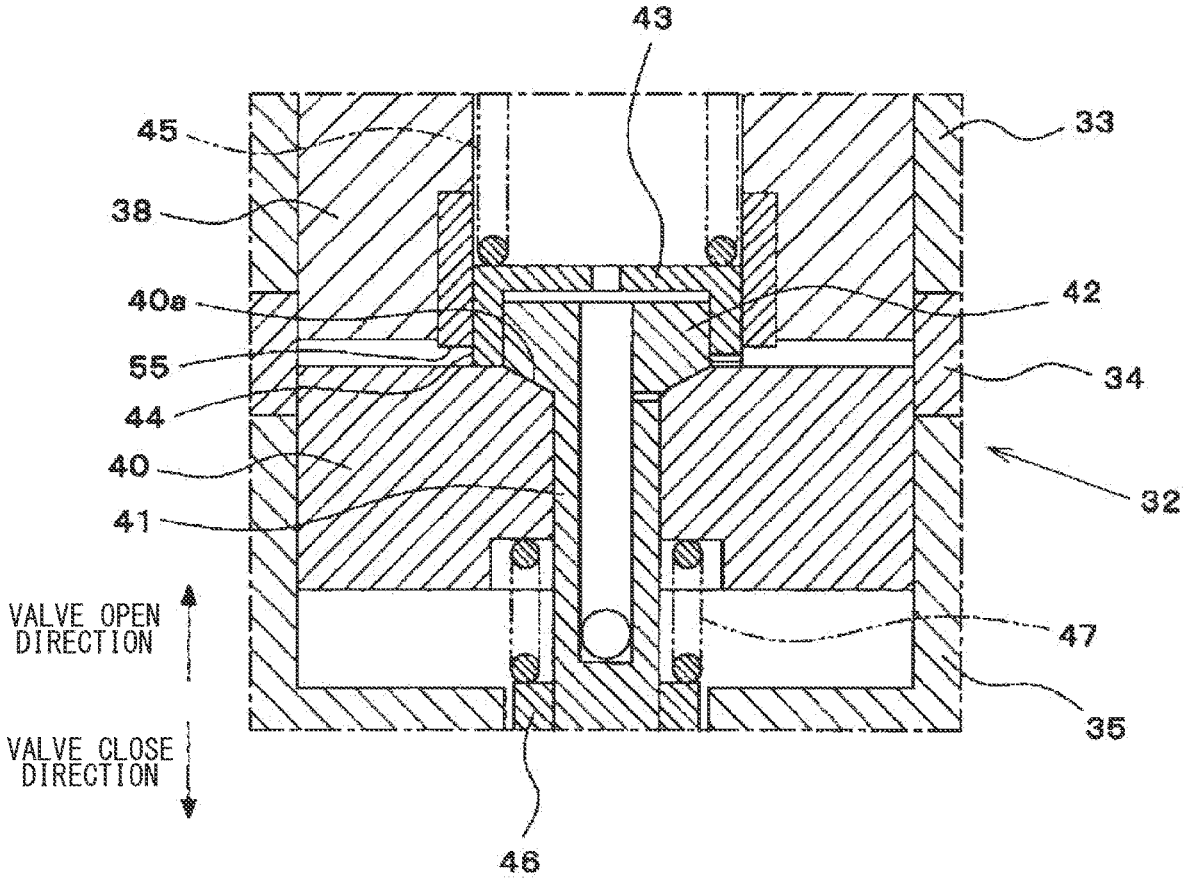
FIG. 4 is an enlarged cross-sectional view showing a state of the fuel injection valve when energized.
Figure 5:
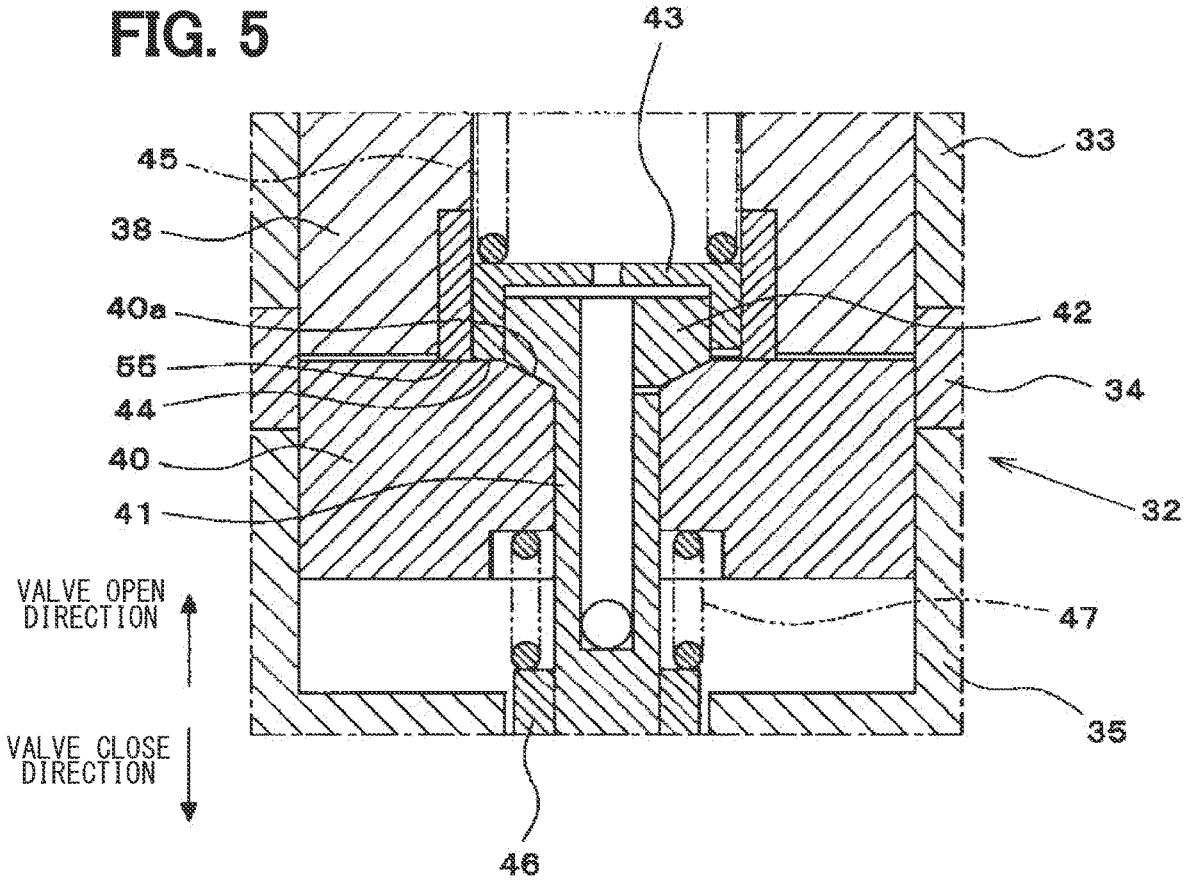
FIG. 5 is an enlarged cross-sectional view showing a state of the fuel injection valve when energized.

To the contrary, when the solenoid 52 is energized, first, as shown in FIG. 4, the movable core 40 is moved in the valve open direction by the electromagnetic attraction force (electromagnetic force) of the solenoid 52. As a result, the cup 43 is pushed by the movable core 40 and moves in the valve open direction, and the tapered portion 40*a* of the movable core 40 is abutted on the collar portion 42 of the needle 41. Subsequently, as shown in FIG. 5, the needle 41 and the cup 43 are pushed by the movable core 40 to move in the valve open direction, and the fuel injection valve 21 is opened (the injection hole 49 is opened). At this time, the upper surface of the movable core 40 makes contact with a stopper 55, so that the upper limit position of the movable core 40 is regulated. As a result, the upper limit position of the needle 41 is regulated, and this upper limit position becomes the full lift position of the needle 41.

Figure 6:
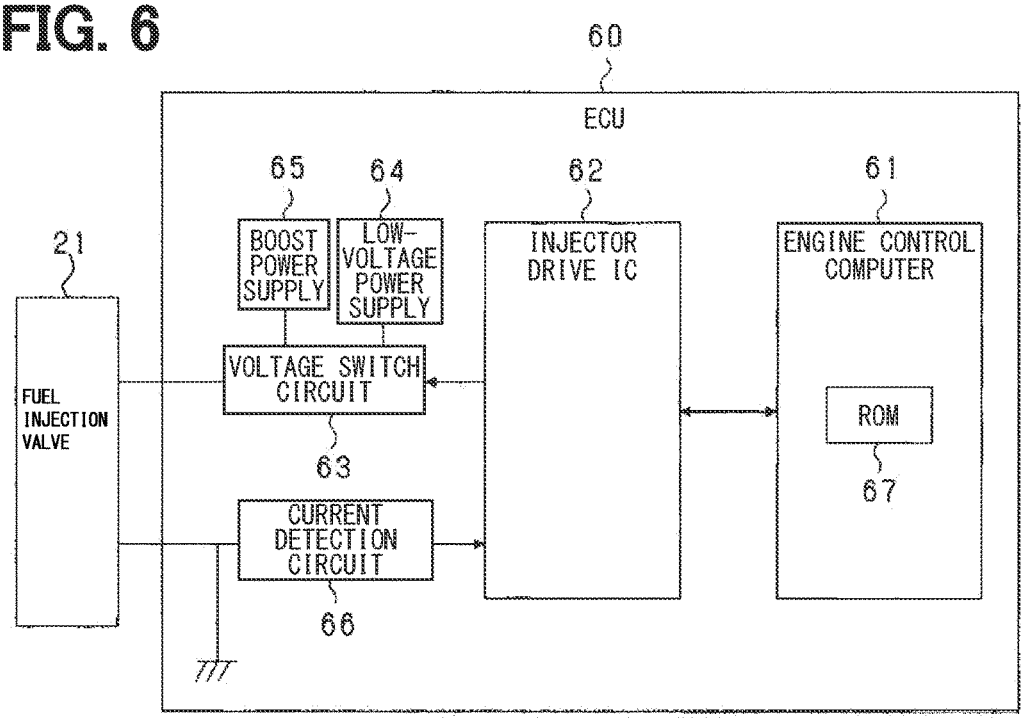
FIG. 6 is a block diagram showing a configuration of an ECU.

Next, the configuration of the ECU 60 will be described with reference to FIG. 6.

The ECU 60 is provided with an engine control microcomputer 61 (microcomputer for controlling the engine 11), an injector drive IC 62 (drive IC for the fuel injection valve 21), and the like. The engine control microcomputer 61 computes a required injection amount in accordance with an engine operation state (such as an engine rotation speed and an engine load). The engine control microcomputer 61 computes an injection pulse width (injection time) according to the required injection amount. The injector drive IC 62 drives the fuel injection valve 21 to open with an injection pulse width corresponding to the required injection amount and performs fuel injection by the required injection amount. At that time, the ECU 60 causes a voltage switching circuit 63 to switch the drive voltage of the fuel injection valve 21 (voltage applied to the solenoid 52) between a low voltage applied by a low voltage power supply 64 and a high voltage applied by a boost power supply 65 (voltage boosted for valve opening). For example, the low voltage power supply 64 is a battery of 12V, and the boost power supply 65 is a boost circuit that boosts the supply voltage of the battery. The ECU 60 detects the drive current of the fuel injection valve 21 (current flowing through the solenoid 52) with a current detection circuit 66 (current detector).

Figure 7:
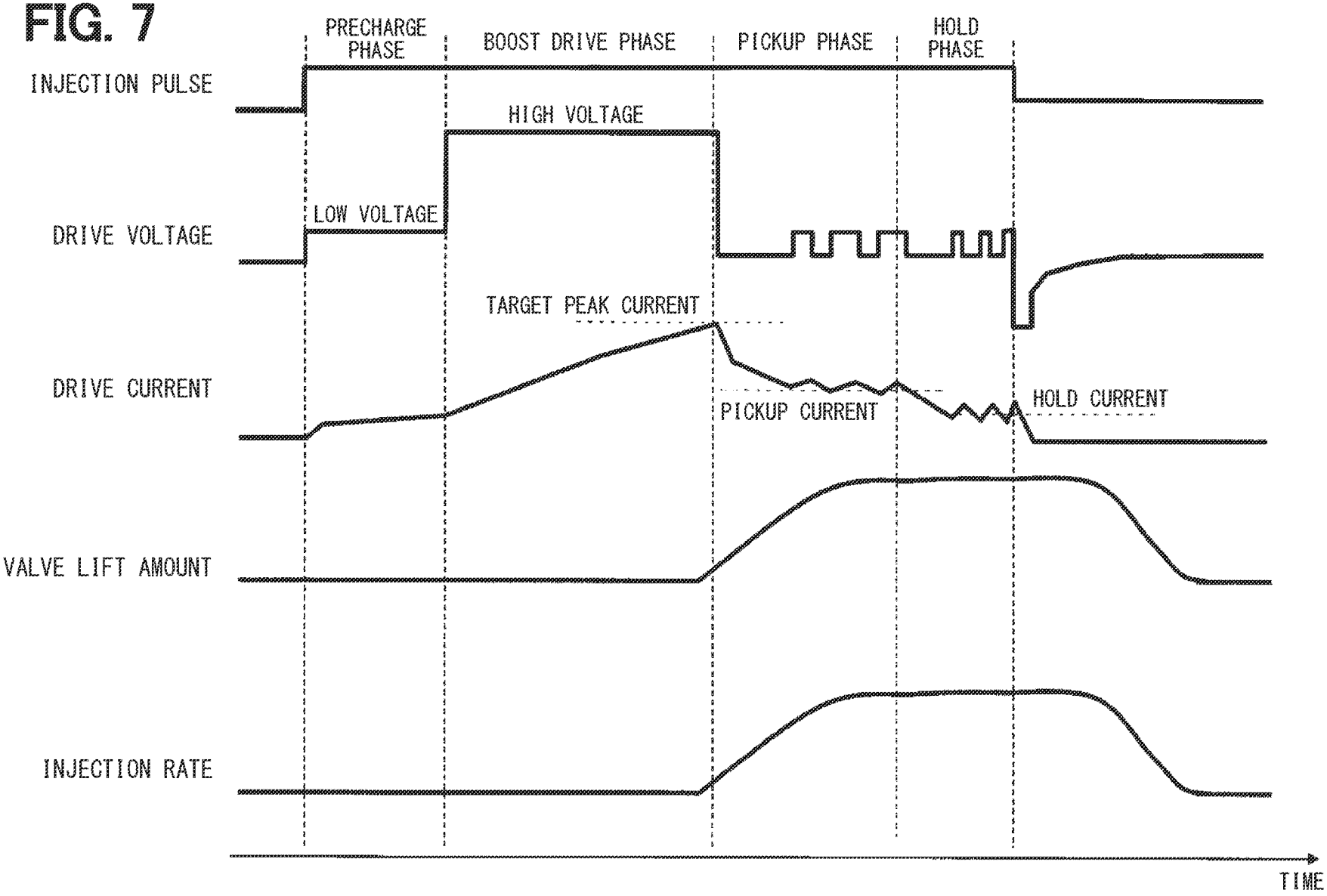
FIG. 7 is a time chart showing a drive current pattern when a supply fuel pressure is normal.

The ECU 60 (at least one of the engine control microcomputer 61 and the injector drive IC 62) functions as a controller that controls the drive current of the fuel injection valve 21 when driving the fuel injection valve 21 to open. FIG. 7 shows an example of the drive current pattern (first current pattern) when the supply fuel pressure is normal. The control of the drive current of the fuel injection valve 21 proceeds, after the injection pulse is turned on, in the order of a precharge phase, a boost drive phase, a pickup phase, and a hold phase.

First, in the precharge phase, a low voltage is applied to the solenoid 52 of the fuel injection valve 21 to gently increase the drive current.

After that, in the boost drive phase, a high voltage (voltage boosted for valve opening) is applied to the solenoid 52 of the fuel injection valve 21 to rapidly increase the drive current to a predetermined target peak current, thereby to open the valve body 50 (needle 41) of the fuel injection valve 21. Subsequently, when the drive current detected by using the current detection circuit 66 (hereinafter referred to as "detection current") reaches the target peak current, the application of the high voltage is stopped.

Subsequently, in the pickup phase, a low voltage is intermittently applied to the solenoid 52 of the fuel injection valve 21 to maintain the drive current around a pickup current lower than the target peak current, thereby to move the valve body 50 of the fuel injection valve 21 to the valve open position.

Subsequently, in the hold phase, a low voltage is intermittently applied to the solenoid 52 of the fuel injection valve 21, thereby to maintain the drive current around the hold current, which is lower than the pickup current, and thereby to maintain the valve body 50 of the fuel injection valve 21 at the valve open position.

Subsequently, when the injection pulse is turned off, the energization of the solenoid 52 of the fuel injection valve 21 is stopped, thereby to cause the valve body 50 of the fuel injection valve 21 to close.

In order to cause the fuel injection valve 21 to inject fuel, it is necessary cause a larger drive current to flow in the solenoid 52, as the fuel pressure supplied to the fuel injection valve 21 becomes higher. Therefore, in a case where the supply fuel pressure increases excessively due to an abnormality caused in the fuel pump or the like, fuel may not be injected with the fuel injection valve even when the drive current is raised to the target peak current. The case where the supply fuel pressure increases excessively may be considered as follows. For example, fuel injection is performed after dead soak to stop the engine 11 when the engine 11 is at a high temperature. Fuel injection is performed after a hybrid vehicle configured to travel by using a motor driving force travels by using the motor driving force. Fuel injection is performed after fuel cut while traveling on a long downhill. In short, when the flow of fuel (circulation) to the fuel injection valve 21 is stopped while the engine 11 is at a high temperature, the supplied fuel pressure may increase excessively.

Figure 8:
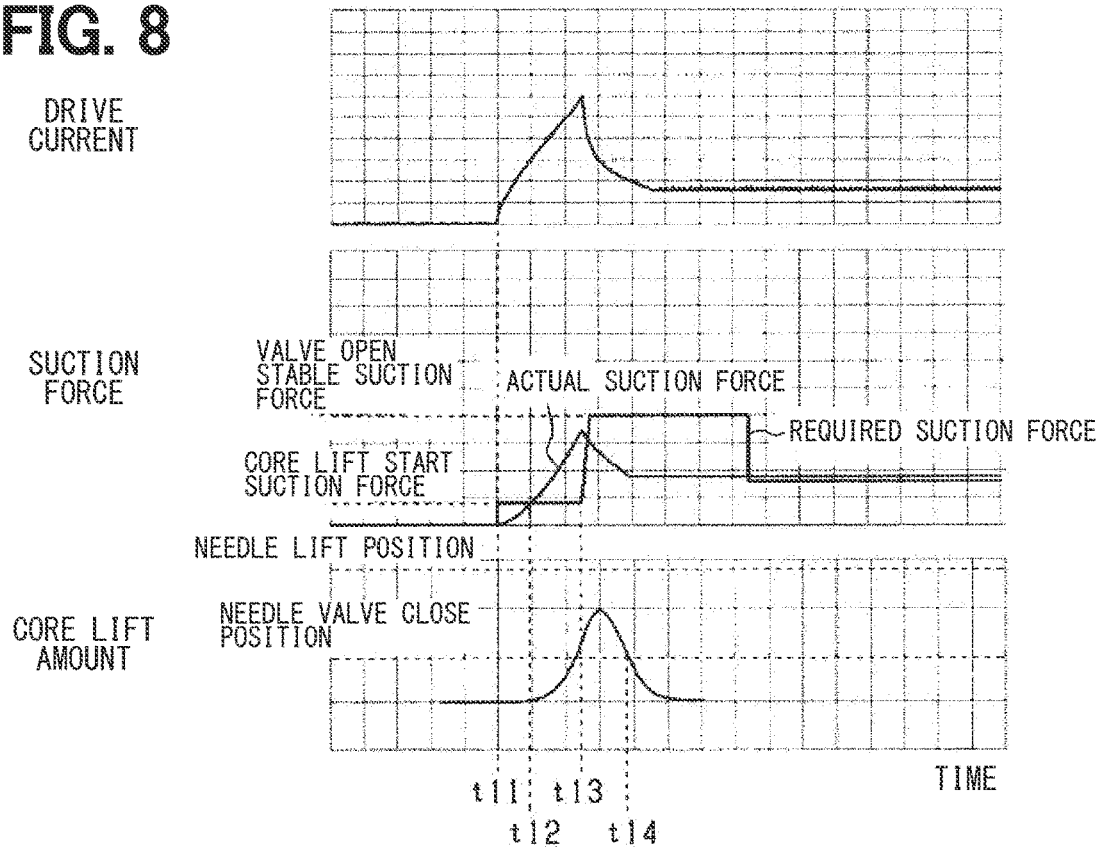
FIG. 8 is a time chart showing the drive current, a suction force, and a core lift amount when the fuel injection valve is not fully opened.

FIG. 8 is a time chart showing the drive current, the suction force, and the core lift amount in a case where the fuel injection valve 21 is not fully opened. In this case, an example is shown where the supplied fuel pressure is excessively increased, and therefore, the necessary suction force required to start the lift of the needle 41 and to maintain the needle 41 at the full lift position is larger than the required suction force when the supplied fuel pressure is normal.

As shown in the figure, when the drive current starts flowing at time t11, the actual suction force (electromagnetic force) that attracts the movable core 40 toward the fixed core 38 is generated. At time t12, when the actual suction force increases to a core lift start suction force required to start the lift of the movable core 40, the lift amount of the movable core 40 starts to increase.

At time t13, when the movable core 40 starts to push the collar portion 42 of the needle 41, the suction force required to lift the needle 41 to the full lift position increases. When the lift amount of the movable core 40 is larger than the needle closing position, the lift amount of the movable core 40 and the lift amount of the needle 41 substantially coincide with each other.

After time t13, the actual suction force is smaller than the required suction force. Therefore, at time t14, the needle 41 returns to the valve closing position before being lifted to the full lift position. That is, in order to lift the needle 41 to the full lift position, it is necessary to increase the actual suction force to be larger than the required suction force until the position of the needle 41 reaches the full lift position.

Figure 9:
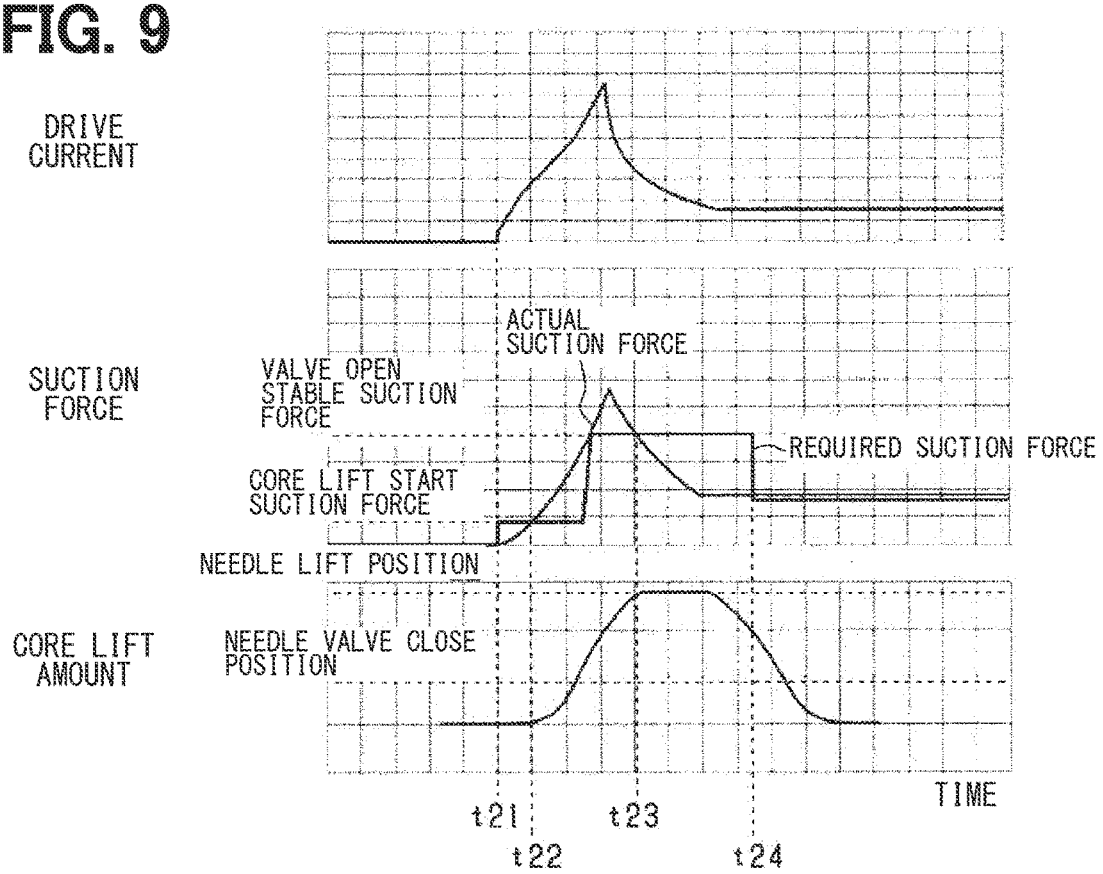
FIG. 9 is a time chart showing the drive current, the suction force, and the core lift amount when the fuel injection valve is not fully opened and is unstable.

FIG. 9 is a time chart showing the drive current, the suction force, and the core lift amount when the fuel injection valve 21 is not fully opened and is unstable. Herein, as in FIG. 8, an example in which the supply fuel pressure is excessively increased is shown.

As shown in the figure, at time t22 to time t23, the actual suction force is larger than the required suction force. Therefore, at time t23, the needle 41 is lifted to the full lift position. When the needle 41 is lifted to the full lift position, the movable core 40 collides with the stopper 55 and rebounds. Therefore, in order to stabilize the fuel injection valve 21 in the valve open state, it is necessary to increase the actual suction force to be larger than a valve open stable suction force until time t24.

To the contrary, after time t23, the actual suction force is smaller than the valve open stable suction force. Therefore, the fuel injection valve 21 cannot be stabilized in the open state, and although the needle 41 is lifted to the full lift position, the needle 41 cannot be held at the full lift position.

Figure 10:
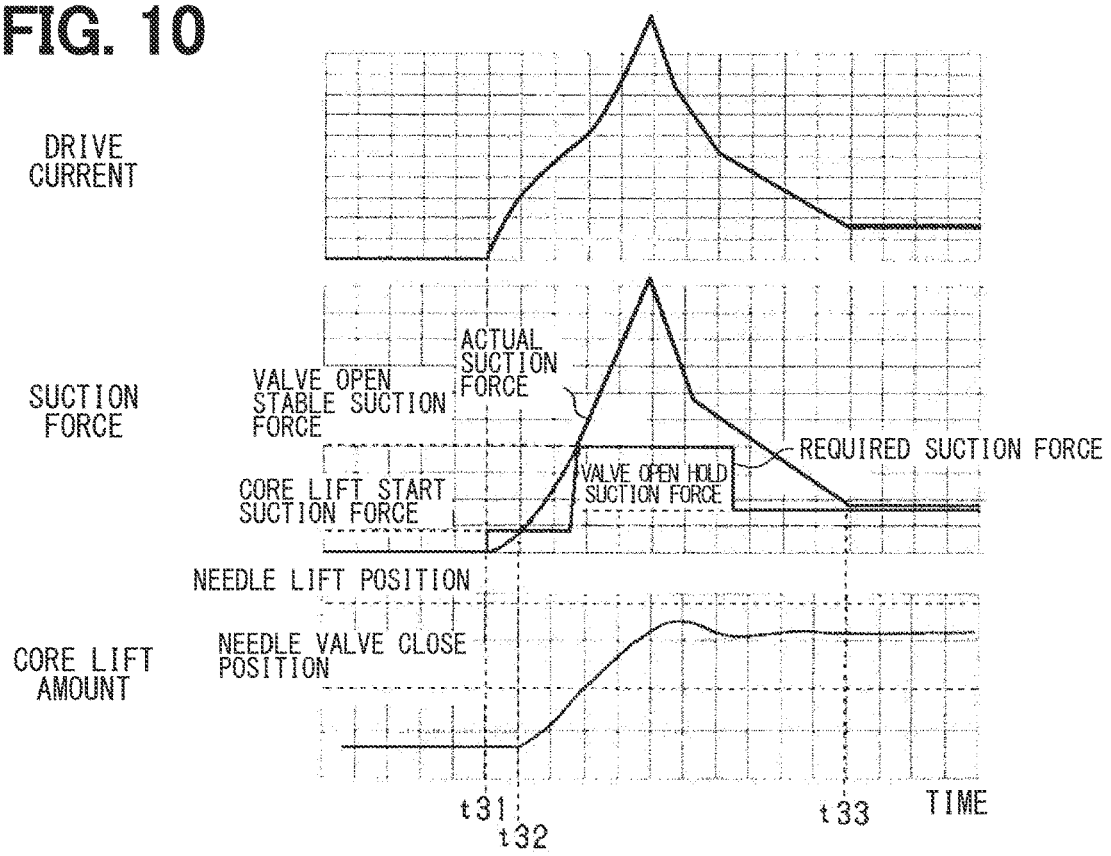
FIG. 10 is a time chart showing the drive current, the suction force, and the core lift amount when the fuel injection valve is fully opened and is stabilized with a driving current having a single peak.

FIG. 10 is a time chart showing the drive current, the suction force, and the core lift amount when the fuel injection valve 21 is fully opened and is stabilized with a driving current having a single peak. Herein, as in FIG. 8, an example in which the supply fuel pressure is excessively increased is shown.

As shown in the figure, after the actual suction force becomes larger than the core lift start suction force at time t32, the actual suction force becomes larger than the required suction force until time t33. Specifically, the actual suction force is maintained in a state of being larger than the valve open stable suction force. Therefore, the needle 41 is lifted to the full lift position, and thereafter maintained at the full lift position. That is, the fuel injection valve 21 is stabilized in the open state.

After time t33, the actual suction force is larger than a valve open hold suction force required to maintain the needle 41 at the full lift position after the needle 41 is lifted to the full lift position. Therefore, the needle 41 is maintained at the full lift position while suppressing the power consumption of the solenoid 52. However, in order to increase the actual suction force to be larger than the required suction force with such a single-peak (singular peak) current pattern, it is necessary to increase the target peak current to be significantly large.

Figure 11:
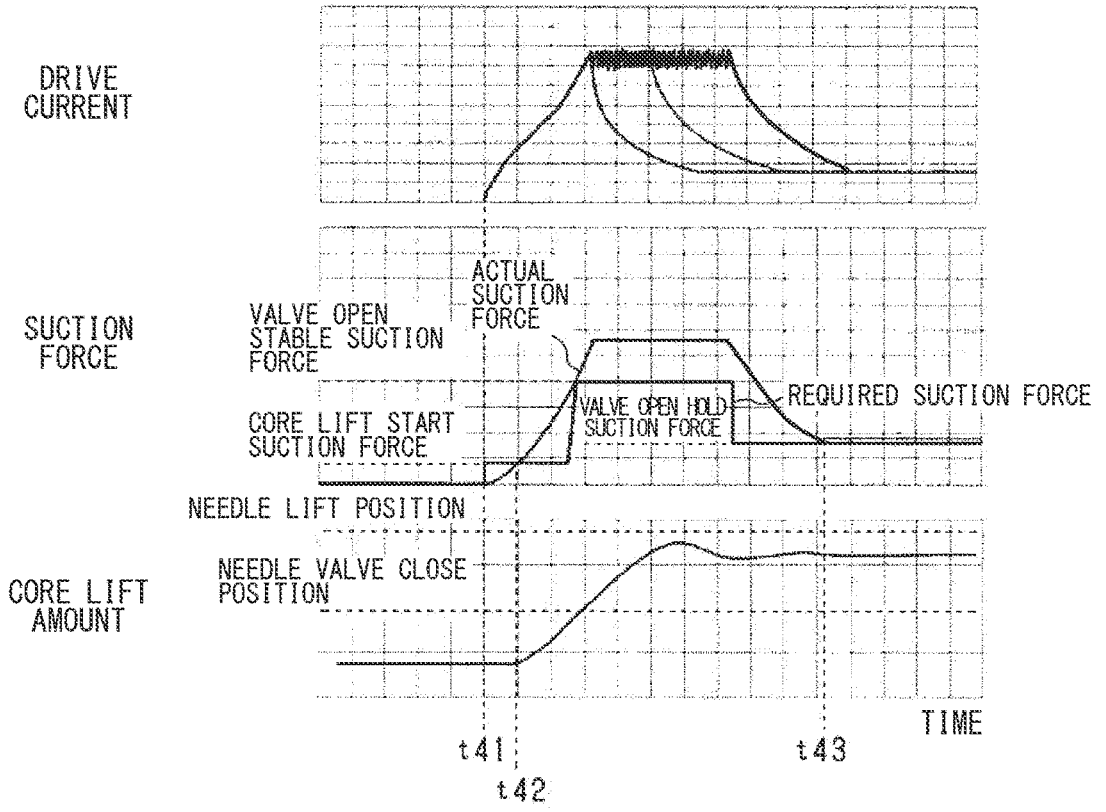
FIG. 11 is a time chart showing the drive current, the suction force, and the core lift amount when the fuel injection valve is fully opened and is stabilized with a driving current having multiple peaks.

To the contrary, FIG. 11 is a time chart showing the drive current, the suction force, and the core lift amount when the fuel injection valve 21 is fully opened and is stabilized with a driving current having multiple peaks. Herein, as in FIG. 8, an example in which the supply fuel pressure is excessively increased is shown.

As shown in the figure, after the actual suction force becomes larger than the core lift start suction force at time t42, the actual suction force becomes larger than the required suction force until time t43. Specifically, the actual suction force is maintained in a state of being larger than the valve open stable suction force. Therefore, the needle 41 is lifted to the full lift position, and thereafter maintained at the full lift position. That is, the fuel injection valve 21 is stabilized in the open state.

After time t43, the actual suction force is larger than the valve open hold suction force required to maintain the needle 41 at the full lift position after the needle 41 is lifted to the full lift position. Therefore, the needle 41 is maintained at the full lift position while suppressing the power consumption of the solenoid 52. Furthermore, the actual suction force is increased to be larger than the required suction force with the current pattern having the multiple peaks (continuous peaks) in this way, it is not necessary to increase the target peak current so large.

Figure 12:
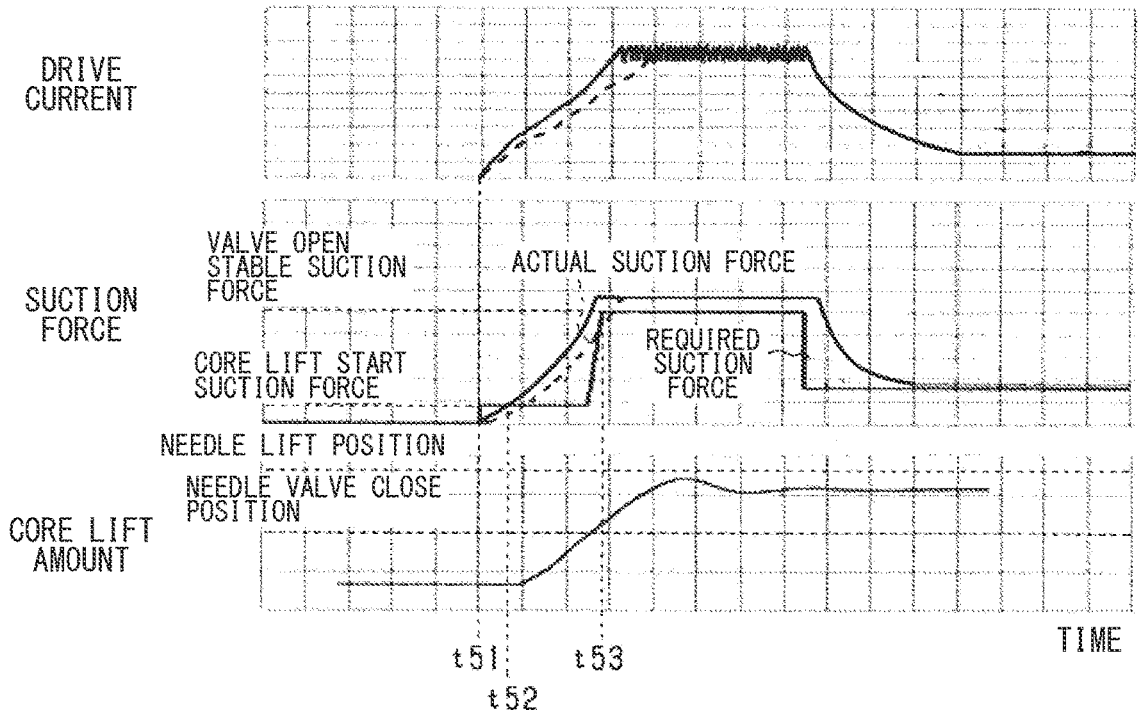
FIG. 12 is a time chart showing the drive current, the suction force, and the core lift amount when the fuel injection valve is fully opened and is stabilized with a driving current that is increased in inclination before multiple peaks.

FIG. 12 is a time chart showing the drive current, the suction force, and the core lift amount when the fuel injection valve 21 is fully opened and is stabilized with a driving current that is increased in inclination before multiple peaks. Herein, as in FIG. 8, an example in which the supply fuel pressure is excessively increased is shown.

With the drive current indicated by the broken line in the figure, the actual attraction force is smaller than the required attraction force at time t53. Therefore, even when the actual suction force is increased to be larger than the required suction force thereafter, the needle 41 cannot be lifted to the full lift position, or the needle 41 cannot be maintained at the full lift position.

To the contrary, with the drive current shown by the solid line, in which the inclination when the drive current increases is large, the actual suction force is therefore not smaller than the required suction force after time t52. Therefore, the needle 41 can be maintained at the full lift position after the needle 41 is lifted to the full lift position. In this way, when the drive current increases, the inclination is increased, thereby to enable to restrict the actual suction force from becoming smaller than the required suction force when the drive current increases.

Figure 13:
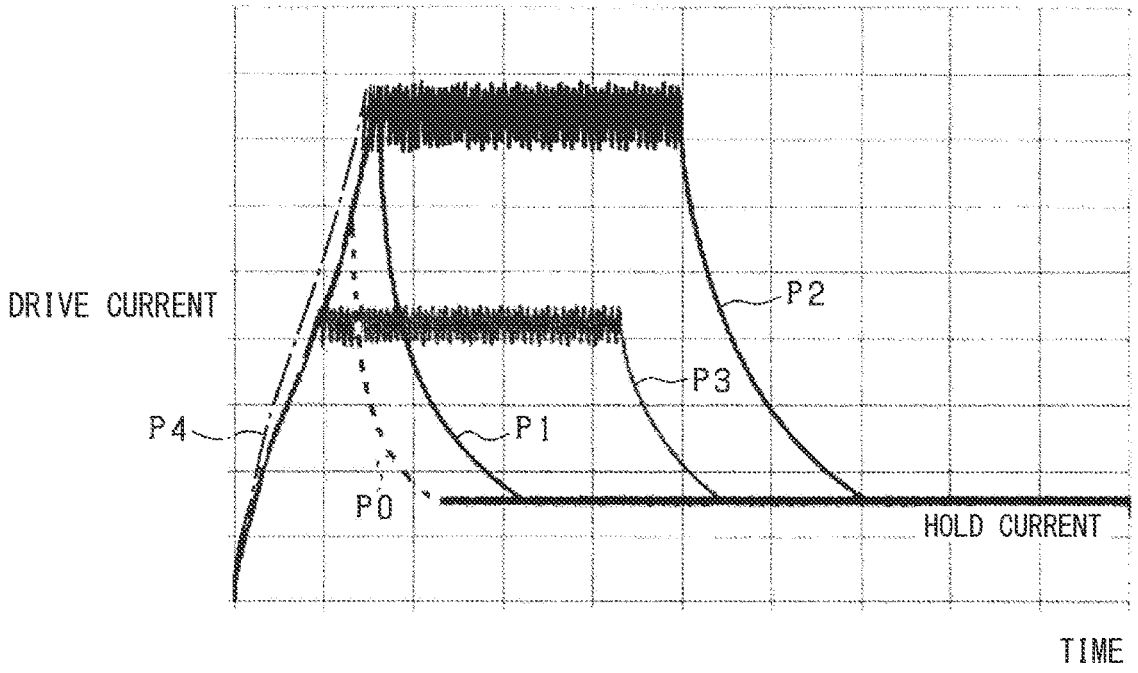
FIG. 13 is a time chart showing an example of a drive current pattern that is set when the supply fuel pressure is abnormally high.

FIG. 13 is a time chart showing an example of a drive current pattern (second current patter) that is set when the supply fuel pressure is abnormally high. Herein, an example is shown in which the precharge phase and the pickup phase of the drive current are omitted. A pattern P0 (broken line) shows a single-peak drive current pattern (first current pattern) when the supply fuel pressure is normal. The pattern P0 includes a hold control in which the drive current is increased to the target peak current (maximum value in the injection period) and then continuously decreased to the hold current (hold value).

In a pattern P1, in the single peak drive current, the target peak current is set to be larger than the target peak current of the pattern P0. The target peak current is the maximum value of the drive current in an injection period from when the fuel injection valve 21 is opened to when the fuel injection valve 21 is closed. The target peak current of the pattern P1 is set to be larger than the upper limit value of the target peak current of the pattern P0, that is, the upper limit value of the target peak current that is set when the supply fuel pressure is normal.

In a pattern P2, in the multiple peak drive current, the target peak current is set to be larger than the target peak current of the pattern P0. The pattern P2 includes a peak hold control and a hold control. The peak hold control maintains the drive current continuously after increasing the drive current to the target peak current (maximum value in the injection period). The hold control reduces the drive current from the target peak current to the hold current and maintains the drive current. The target peak current of the pattern P2 is set to be larger than the upper limit value of the target peak current of the pattern P0, that is, the upper limit value of the target peak current that is set when the supply fuel pressure is normal.

In a pattern P3, in the multiple peak drive current, the target peak current is set to be smaller than the target peak current of the pattern P0. The pattern P3 includes a peak hold control and a hold control. The peak hold control maintains the drive current continuously after increasing the drive current to the target peak current. The hold control reduces the drive current from the target peak current to the hold current and maintains the drive current. The target peak current of the pattern P3 is set to be smaller than the upper limit value of the target peak current of the pattern P0, that is, the upper limit value of the target peak current that is set when the supply fuel pressure is normal. It is noted that, as shown in FIG. 11, the drive current of the pattern P3 is set so that the actual attraction force is larger than the required attraction force.

In a pattern P4, in the multiple peak drive current, when the drive current increases, the inclination is set to be larger than the inclination when the drive current increases in the pattern P0. Specifically, the voltage applied to the solenoid 52 when the drive current is increased to the target peak current is set to be larger than the voltage applied to the solenoid 52 in the pattern P0 when the drive current is increased to the target peak current. The inclination of the pattern P4 when the drive current increases is set to be larger than the upper limit of the inclination of the pattern P0 when the drive current increases, that is, the upper limit of the inclination when the drive current increases, which is set when the supply fuel pressure is normal. The pattern P4 is an example in which the control to increasing the inclination when the drive current increases is applied to the pattern P2. The control to increase the inclination when the drive current increases may be applied not only to the pattern P2 but also to the patterns P0, P1 and P3.

Further, in the patterns P1 to P4, a control may be performed to maintain the drive current at the pickup current before holding the drive current at the hold current, after increasing the drive current to the target peak current or after increasing the drive current to the target peak current and holding the target peak current. All of the above controls including these modified examples correspond to the second current pattern of the drive current that is set when the supply fuel pressure is abnormally high.

Figure 14:
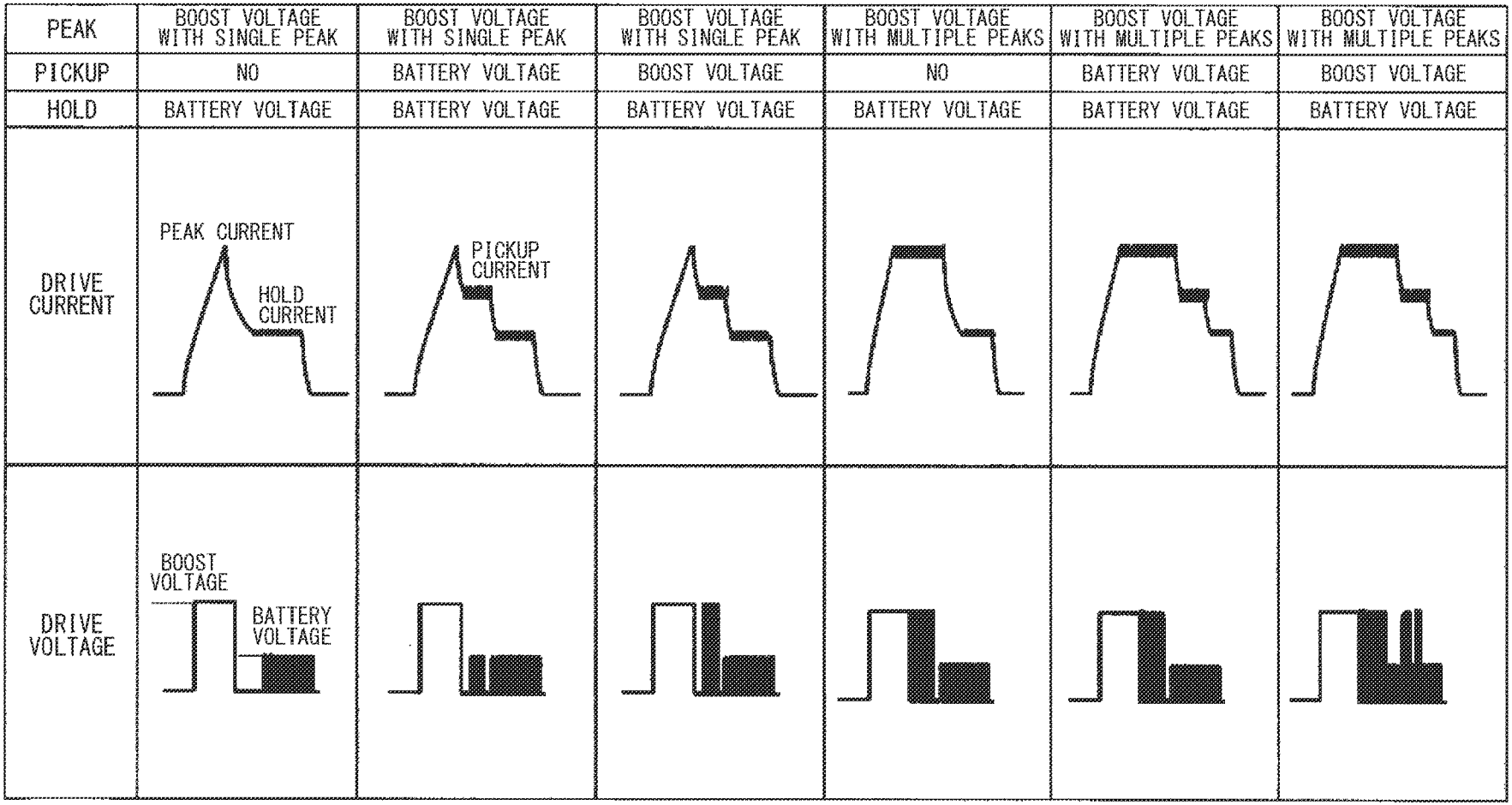
FIG. 14 is a schematic view showing examples of combinations of a peak shape of the drive current, presence/absence of a pickup control, and a level of the drive voltage.

FIG. 14 is a schematic view showing examples of combinations of the peak shape of the drive current, presence/absence of the pickup control, and the level of the drive voltage.

As shown in the figure, the ECU 60 is configured to select the single peak or the multiple peak as the peak shape of the drive current. The high voltage supplied from the boost power source 65 is used as the drive voltage when the drive current is increased to the target peak current.

As the pickup control, the ECU 60 is configured to select whether to perform the pickup control or not. The battery voltage (low voltage) supplied from the low voltage power supply 64 and the boost voltage (high voltage) supplied from the boost power supply 65 may be selected as the drive voltage when the pickup control is performed.

In the hold control, the ECU 60 maintains the drive current at the hold current with the battery voltage supplied from the low voltage power supply 64.

In this way, the ECU 60 sets the second current pattern by combining the peak shape of the drive current, the presence or absence of the pickup control, and the level of the drive voltage.

Figure 15:
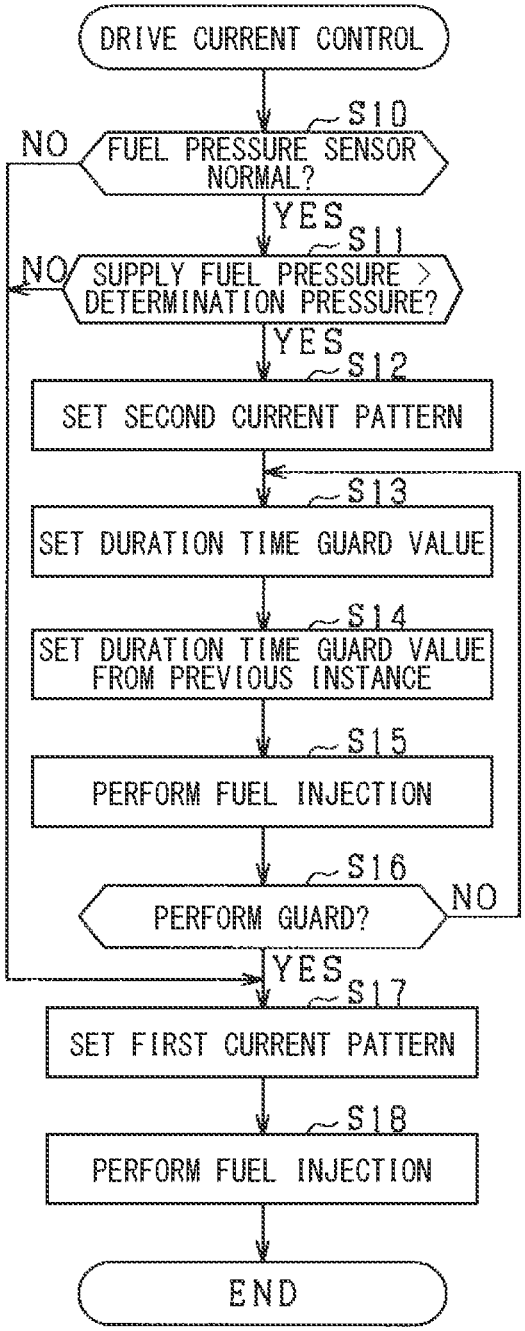
FIG. 15 is a flowchart showing a procedure of a drive current control.

FIG. 15 is a flowchart showing a procedure of the drive current control. This series of the procedure is repeatedly executed by the ECU 60.

First, it is determined whether or not the fuel pressure sensor 57 is normal (S10). For example, it is determined whether or not a detected value of the supplied fuel pressure detected by using the fuel pressure sensor 57 is within a range of a normal value. In this determination, when it is determined that the fuel pressure sensor 57 is not normal (S10: NO), the drive current is set to the first current pattern (S17). The first current pattern (first mode) is a pattern of a drive current to flow through the solenoid 52 of the fuel injection valve 21 when the supply fuel pressure is within the normal value range. Subsequently, the drive current is controlled with the first current pattern (for example, the pattern P0 in FIG. 13), and the fuel is injected by using the fuel injection valve 21 (S18). Subsequently, the procedure is terminated (END).

To the contrary, in the determination of S10, when it is determined that the fuel pressure sensor 57 is normal (S10: YES), it is determined whether or not the supply fuel pressure detected by using the fuel pressure sensor 57 is higher than a determination pressure (S11). The determination pressure is a pressure for determining that the supply fuel pressure is abnormally high and is a pressure that cannot arise under a normal condition. As the determination pressure, for example, a pressure, at which the fuel injection valve 21 cannot be fully opened when the drive current is controlled with the first current pattern, is adopted. In a case where this determination pressure is adopted, when the movable core 40 collides against the collar portion 42 of the needle 41, the needle 41 may be lifted to a position before the full lift position. In the determination, when it is determined that the supply fuel pressure detected by using the fuel pressure sensor 57 is not higher than the determination pressure (S11: NO), the processing proceeds to S17. In the process of S11, it may be determined whether or not the supply fuel pressure is equal to or higher than the determination pressure.

To the contrary, in the determination of S11, when it is determined that the supply fuel pressure detected by using the fuel pressure sensor 57 is higher than the determination pressure (S11: YES), the drive current is set to the second current pattern (S12). For example, it is set such that any of the patterns P1 to P4 in FIG. 13 is formed by any of the combinations in FIG. 14. Herein, the higher the rotation speed of the engine 11, the shorter the interval between the fuel injection and the fuel injection. Therefore, in the case of the multiple peak drive current, the heat generated by the ECU 60 tends to accumulate when the drive current is maintained at the target peak current. Therefore, the temperature of the ECU 60 may exceed its heat resistant temperature. Therefore, in the second current pattern, the period, during which the drive current is continuously maintained after being increased to the target peak current (see the peak duration Tp in FIG. 16), is set shorter, as the rotation speed of the engine 11 becomes higher.

Figure 16:
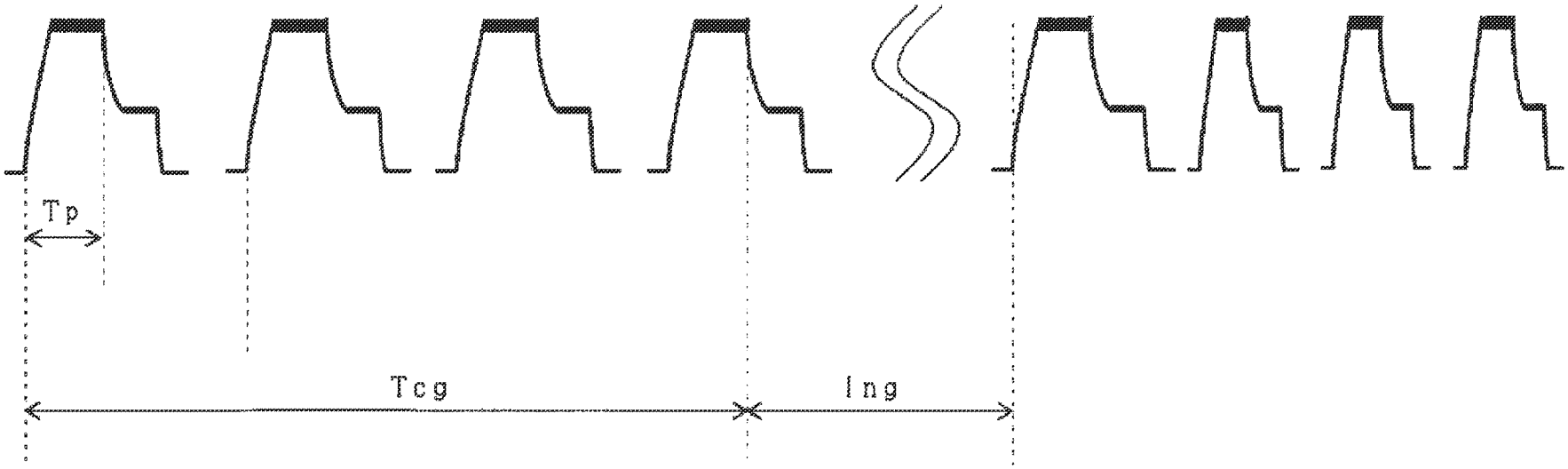
FIG. 16 is a time chart showing a duration guard value and an elapsed time guard value.
Figure 17:
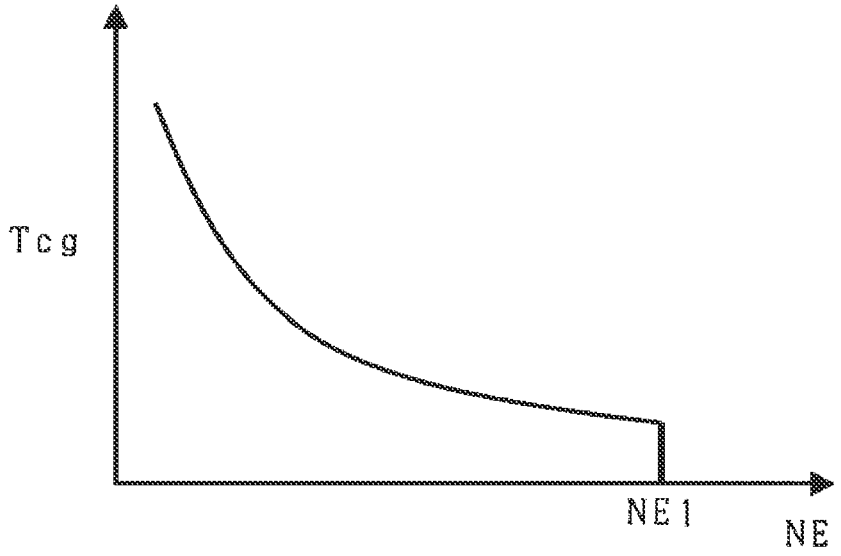
FIG. 17 is a graph showing a relationship between an engine rotation speed and the duration guard value.

Subsequently, a duration guard value Tcg is set (S13). As shown in FIG. 16, the duration guard value Tcg (predetermined period) is an upper limit of a period, during which the fuel injection valve 21 can be continuously driven with the second current pattern, when fuel injections by using the multiple fuel injection valves 21 are continuously performed. That is, the duration guard value Tcg is an upper limit of the period, during which the drive current can be continuously controlled with the second current pattern. As shown in FIG. 17, as the rotation speed NE of the engine 11 becomes higher, the duration guard value Tcg is set to be shorter. When the rotation speed NE of the engine 11 is higher than a predetermined rotation speed NE1, the duration guard value Tcg is set to 0. That is, when the rotation speed NE of the engine 11 is higher than the predetermined rotation speed NE1, the drive current is not set with the second current pattern, but the drive current is set with the first current pattern. The graph of FIG. 17 may be set according to the heat resistant temperature of the ECU 60.

Figure 18:
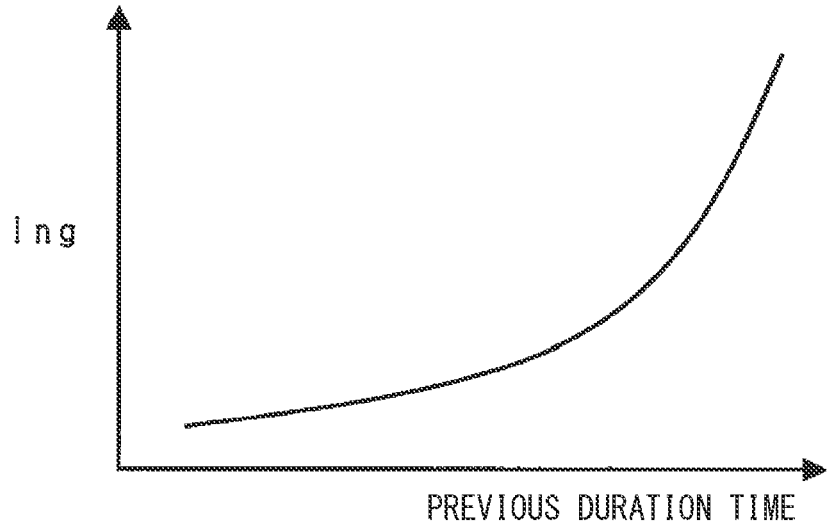
FIG. 18 is a graph showing a relationship between a previous duration time and the elapsed time guard value.

Subsequently, an elapsed time guard value Ing from the previous instance is set (S14). As shown in FIG. 16, the elapsed time guard value Ing is a lower limit of a period, which is from the time, when the fuel injections of the multiple fuel injection valves 21 with the second current pattern are stopped, until the time, when the fuel injections of the multiple fuel injection valves 21 with the second current pattern can be started. As shown in FIG. 18, as the previous duration of fuel injection with the second current pattern becomes longer, the elapsed time guard value Ing is set to be longer. The graph of FIG. 18 may be set according to the heat resistant temperature of the ECU 60.

Subsequently, the drive current is controlled with the second current pattern, and the fuel is injected by using the fuel injection valve 21 (S15).

Subsequently, it is determined whether the guard with the duration guard value Tcg is performed or the guard with the elapsed time guard value Ing is performed (S16). In this determination, when it is determined that neither the guard with the duration guard value Tcg nor the guard with the elapsed time guard value Ing is performed (S16: NO), the processing is executed again from the process of S13. That is, in a case where the duration of fuel injections of the multiple fuel injection valves 21 with the second current pattern is shorter than the duration guard value Tcg and where the elapsed time from the end of the previous fuel injection with the second current pattern is longer than the elapsed time guard value Ing, the processing is executed again from the process of S13.

To the contrary, in the determination of S16, when it is determined that the guard with the duration guard value Tcg is performed or that the guard with the elapsed time guard value Ing is performed (S16: YES), the processing proceeds to S17. That is, in a case where the duration of the fuel injections of the multiple fuel injection valves 21 with the second current pattern is longer than the duration guard value Tcg or where the elapsed time from the end of the previous fuel injection with the second current pattern is shorter than the elapsed time guard value Ing, the processing proceeds to S17. Subsequently, the drive current is set to the first current pattern (S17), fuel is injected by using the fuel injection valve 21 with the first current pattern (S18), and this series of processing is completed (END).

The process of S11 corresponds to a process of a determination unit. The process of S17 corresponds to a process of a first control unit. The process of S12 corresponds to a process of a second control unit.

The present embodiment described above in detail has the following advantages.

It is determined whether or not the supply fuel pressure, which is the pressure of fuel supplied to the fuel injection valve 21, is higher than the determination pressure for determining that the fuel pressure is abnormally high. In addition, in a case where it is determined that the supply fuel pressure is not higher than the determination pressure, the drive current is controlled with the first current pattern. Alternatively, in a case where it is determined that the supply fuel pressure is higher than the determination pressure, the drive current is controlled with the second current pattern that facilitates to maintain the open state of the fuel injection valve 21 compared with the first current pattern. Therefore, even when the supply fuel pressure is higher than the determination pressure, the configuration enables the fuel injection valve 21 to perform fuel injection.

The power consumption of the second current pattern is larger than the power consumption of the first current pattern. In this respect, when the supply fuel pressure is not higher than the determination pressure, that is, when the supply fuel pressure is normal, the drive current is controlled with the first current pattern. Therefore, the configuration enables to suppress increase in power consumption.

The determination pressure is the pressure, at which the fuel injection valve 21 cannot be fully opened when the drive current is controlled with the first current pattern. Therefore, when the supply fuel pressure becomes higher than the determination pressure and when the drive current is controlled with the first current pattern, the fuel injection valve 21 cannot be fully opened. In that case, the configuration controls the drive current with the second current pattern thereby to enable to fully open the fuel injection valve 21 to inject fuel.

In the fuel injection valve 21 having the core boost structure, the drive current required to move the movable core 40 and the needle 41 becomes larger than the drive current required to move only the movable core 40. Therefore, the valve body 50 cannot be moved to the fully open position unless the drive current, when the movable core 40 and the needle 41 are moved, is larger than the predetermined current. In this respect, in the pattern P4 in FIG. 13, the voltage applied to the solenoid 52 when the drive current is increased to the target peak current is set to be larger than the voltage applied to the solenoid 52 in the pattern P0 when the drive current is increased to the target peak current. Therefore, the configuration enables to facilitate to increase the drive current when the needle 41 is moved to be larger than the predetermined current. Therefore, the configuration enables to cause the fuel injection valve 21 to inject fuel at a higher supply fuel pressure.

The pattern P2 and P3 in FIG. 13 includes the peak hold control and the hold control. The peak hold control maintains the drive current continuously after increasing the drive current to the target peak current. The hold control reduces the drive current from the target peak current to the hold current and maintains the drive current. In peak hold control, the drive current is increased to the target peak current and subsequently maintained continuously. Therefore, the configuration enables to continuously maintain the electromagnetic force generated by using the solenoid 52 after increasing the electromagnetic force to the maximum value. In addition, the configuration enables to facilitate to open the fuel injection valve 21 and to maintain the fuel injection valve 21 in the open state. Further, the configuration reduces the drive current from the target peak current to the hold current and holds the drive current. Therefore, the configuration enables to suppress the power consumption when the fuel injection valve 21 is maintained in the open state.

In the pattern P0 in FIG. 13, the drive current is increased to the target peak current and subsequently decreased continuously to the hold current and is maintained. To the contrary, in the pattern P2, the drive current is maintained at the target peak current that is larger than the target peak current of the drive current in the pattern P0. Therefore, the configuration enables to facilitate to maintain the fuel injection valve 21 in the open state with the pattern P2 as compared with the pattern P0.

In the pattern P3 in FIG. 13, the drive current is maintained at the target peak current that is smaller than the target peak current of the drive current in the pattern P0. That is, as shown in FIGS. 9 and 11, even in a case where the target peak current of the drive current in the pattern P3 is smaller than the target peak current of the drive current in the pattern P0, the configuration continues to maintain the drive current after increasing the drive current to target peak current thereby to enable to facilitate to maintain the fuel injection valve 21 in the open state. Therefore, the configuration enables to facilitate to maintain the fuel injection valve 21 in the open state and to suppress increase in power consumption.

The ECU 60 sets the period, in which the drive current is maintained after the drive current is increased to the target peak current, to be shorter, as the rotation speed of the engine 11 increases. Therefore, the configuration enables to restrict the temperature of the ECU 60 from exceeding the heat resistant temperature even when the rotation speed of the engine 11 is increased. The period in which the drive current is maintained at the target peak current may be specified by the time or by the crank angle.

In a case where the period, in which the drive current is continuously controlled with the second current pattern, becomes excessively long, the temperature of the ECU 60 may exceed the heat resistant temperature. In this respect, the ECU 60 switches the drive current with the second current pattern to the drive current with the first current pattern when the period in which the drive current is continuously controlled with the second current pattern becomes longer than the duration guard value Tcg. Therefore, when the temperature of the ECU 60 increases due to controlling of the drive current with the second current pattern continuously, the ECU 60 switches the drive current to be with the first current pattern thereby to enable to suppress the increase in temperature of the ECU 60. The period in which the drive current is continuously controlled with the second current pattern and the duration guard value Tcg may be specified by the time or by the crank angle.

The embodiment described above may be modified in the following manners. Elements identical to the elements of the above embodiment are designated by the same reference signs as the above embodiment, and redundant description thereof is omitted.

The ECU 60 may adopt, as the determination pressure, a pressure at which fuel cannot be injected by using the fuel injection valve 21 when the drive current is controlled with the first current pattern (first mode). In particular, in an electromagnetically driven fuel injection valve that does not have the core boost structure, in a case where the supply fuel pressure becomes abnormally high, the fuel injection valve 21 tends to be uncapable of injecting fuel.

According to the above-described configuration, when the supply fuel pressure becomes higher than the determination pressure and when the drive current is controlled with the first current pattern, the fuel injection valve 21 cannot inject fuel. In that case, the configuration controls the drive current with the second current pattern (second mode) thereby to enable to cause the fuel injection valve 21 to inject fuel.

A high-voltage battery that is at a voltage higher than the voltage of the 12V battery may be adopted instead of the boost power supply 65. Further, the boost voltage may be applied by increasing the generated voltage of the generator that applies the voltage to the fuel injection valve 21.

Figure 19:
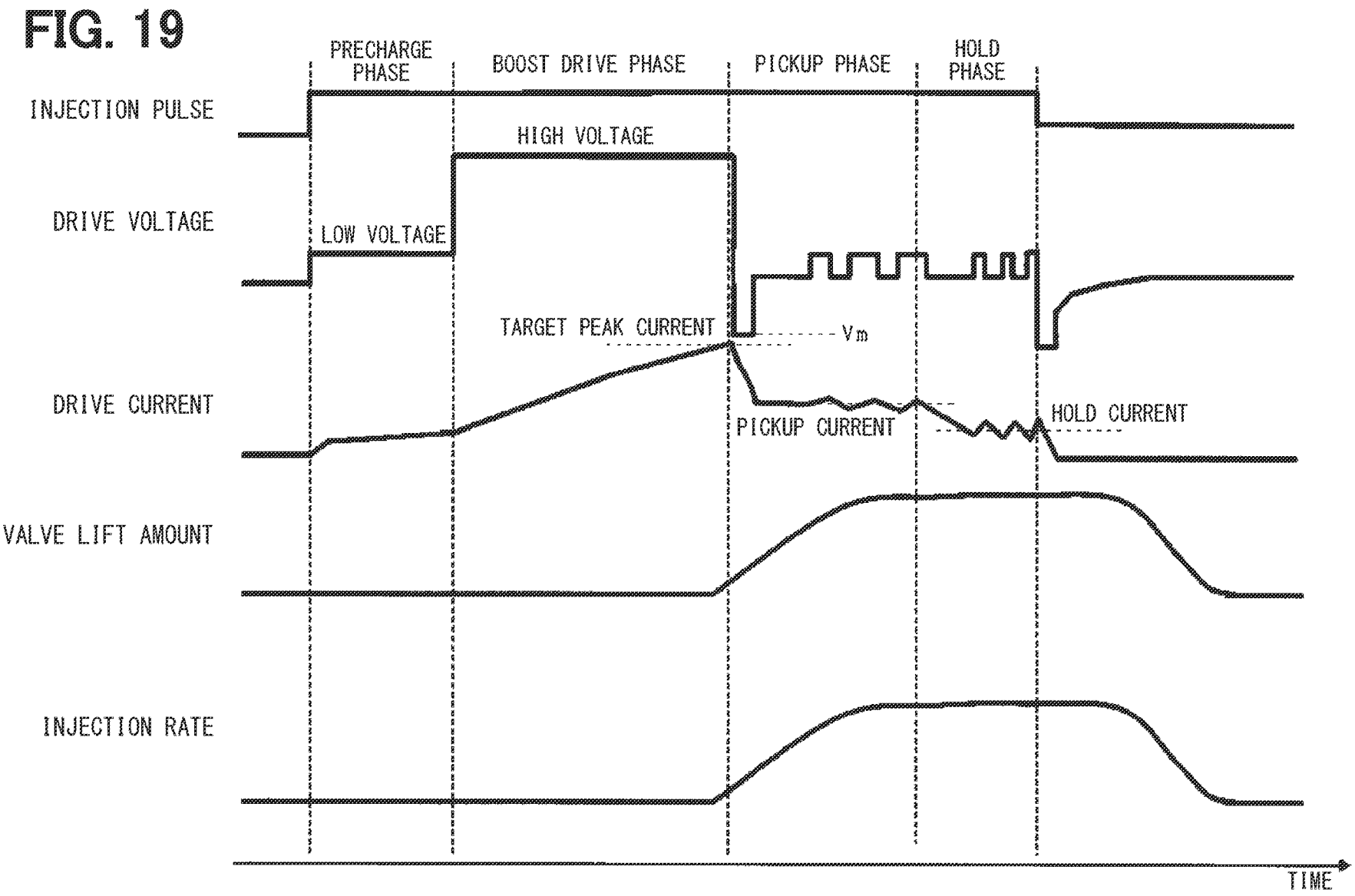
FIG. 19 is a time chart showing a drive current pattern when the supply fuel pressure is normal according to a modified example.

The ECU 60 may adopt a current pattern shown in FIG. 19 as the first current pattern (first mode). This first current pattern includes a control to apply a voltage Vm to the solenoid 52 in the direction to decrease the drive current after increasing the drive current to the target peak current (maximum value in the injection period). This configuration enables to suppress noise caused when the fuel injection valve 21 is fully opened.

To the contrary, the second current pattern (second mode) does not include the control to apply the voltage Vm to the solenoid 52 in the direction to decrease the drive current after increasing the drive current to the target peak current. Therefore, in the case where the drive current is controlled with the second current pattern, the voltage Vm is not applied to the solenoid 52 in the direction to decrease the drive current after the drive current is increased to the target peak current. Therefore, when the supply fuel pressure increases excessively, the configuration enables to prioritize the ease of maintaining the open state of the fuel injection valve 21 rather than suppressing noise. In the patterns P2 and P3 in FIG. 13, after the peak hold control to maintain the drive current at the target peak current is completed, the control to apply the voltage Vm to the solenoid 52 in the direction to reduce the drive current may be performed.

The ECU 60 (second control unit) may set the period to continuously maintain the drive current after increasing the drive current to the target peak current to a period until the fuel injection valve 21 is stabilized in the open state. This configuration enables to increase the drive current to the target peak current and subsequently to maintain the drive current at the target peak current until the fuel injection valve 21 is stabilized in the open state, when the drive current is controlled with the second current pattern. Therefore, even when the supply fuel pressure increases excessively, the configuration enables to cause the fuel injection valve 21 to perform stable fuel injection. The period until the fuel injection valve 21 is stabilized in the open state may be acquired in advance based on an experiment or the like. The period until the valve is stabilized in the opened state may be specified by the time or the crank angle.

In FIG. 15, the ECU 60 may execute the same determination as in S11 between the process of S15 and the process of S16. In this determination, when it is determined that the supply fuel pressure detected by using the fuel pressure sensor 57 is not higher than the determination pressure, the processing proceeds to S17. When it is determined that the supply fuel pressure is higher than the determination pressure, the processing proceeds to S16. That is, the ECU 60 (second control unit) may switch the drive current with the second current pattern to the drive current with the first current pattern when the supply fuel pressure becomes equal to or lower than the determination pressure. This configuration enables to switch the drive current with the second current pattern to the drive current with the first current pattern when the supply fuel pressure becomes equal to or lower than the determination pressure. Therefore, the configuration enables to suppress the drive current from being controlled with the second current pattern more than as required to suppress increase in temperature of the ECU 60 and to suppress the increase in power consumption.

Figure 20:
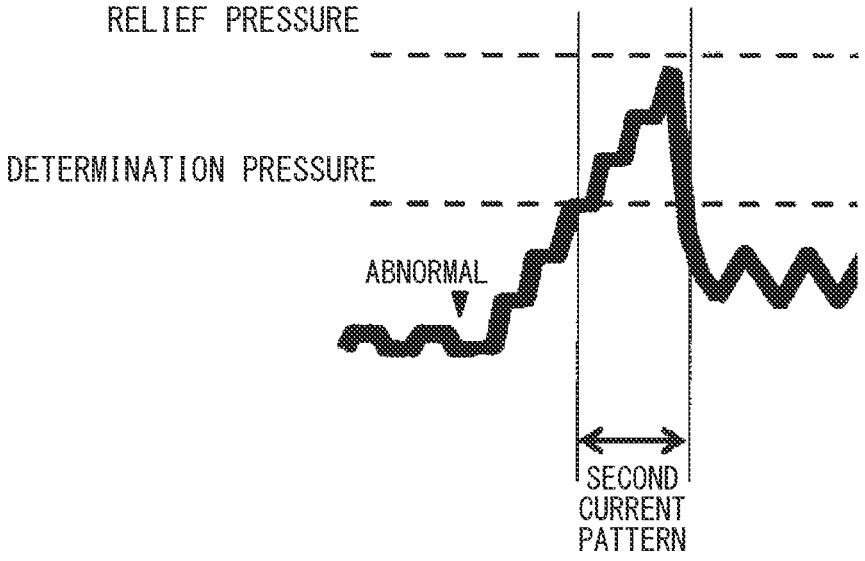
FIG. 20 is a time chart showing a relationship between the supply fuel pressure and a relief pressure.

Further, a relief valve may be provided to a delivery pipe that is to supply fuel to the fuel injection valve 21. As shown in FIG. 20, the relief valve opens to reduce the fuel pressure in the delivery pipe when the fuel pressure in the delivery pipe becomes higher than a relief pressure. In this configuration, in a case where the supply fuel pressure becomes higher than the determination pressure and where the drive current is controlled with the second current pattern, the relief valve opens when the fuel pressure in the delivery pipe becomes higher than the relief pressure. The configuration switches the drive current with the second current pattern to the drive current with the first current pattern when the supply fuel pressure becomes lower than the determination pressure consequently. In addition, when the supply fuel pressure does not become lower than the determination pressure immediately after the relief valve opens, the configuration controls the drive current with the second current pattern until the supply fuel pressure becomes lower than the determination pressure.

Although the present disclosure has been described in accordance with the examples, it is understood that the present disclosure is not limited to such examples or structures. The present disclosure encompasses various modifications and variations within the scope of equivalents. In addition, while the various combinations and configurations, which are preferred, other combinations and configurations, including more, less or only a single element, are also within the spirit and scope of the present disclosure.

What is claimed is:

1. A control device configured to control a drive current that flows through a drive coil of a fuel injection valve that is configured to be electromagnetically driven, the control device comprising:

a determination unit configured to determine whether a supply fuel pressure, which is a pressure of fuel supplied to the fuel injection valve, is higher than a determination pressure at which the fuel pressure is determined abnormally high;

a first control unit configured to control the drive current in a first mode, when the determination unit determines that the supply fuel pressure is not higher than the determination pressure; and a second control unit configured to control the drive current in a second mode that facilitates maintaining of the fuel injection valve in an open state more than in the first mode, when the determination unit determines that the supply fuel pressure is higher than the determination pressure, wherein a voltage applied to the drive coil when the drive current is increased to a maximum value in an injection period in the second mode is higher than a voltage applied to the drive coil when the drive current is increased to a maximum value in an injection period in the first mode.

2. The control device for the fuel injection valve according to claim 1, wherein the second mode includes a control to continuously maintain the drive current after increasing the drive current to a maximum value in an injection period and a control to reduce the drive current from the maximum value in the injection period to a hold value and to maintain the drive current.

3. The control device for the fuel injection valve according to claim 2, wherein the first mode includes a control to increase the drive current to the maximum value in the injection period and subsequently to continuously decrease the drive current to the hold value and to maintain the drive current, and the maximum value of the drive current in the injection period in the second mode is larger than the maximum value of the drive current in the injection period in the first mode.

4. A control device configured to control a drive current that flows through a drive coil of a fuel injection valve that is configured to be electromagnetically driven, the control device comprising:

a determination unit configured to determine whether a supply fuel pressure, which is a pressure of fuel supplied to the fuel injection valve, is higher than a determination pressure at which the fuel pressure is determined abnormally high;

a first control unit configured to control the drive current in a first mode, when the determination unit determines that the supply fuel pressure is not higher than the determination pressure; and a second control unit configured to control the drive current in a second mode that facilitates maintaining of the fuel injection valve in an open state more than in the first mode, when the determination unit determines that the supply fuel pressure is higher than the determination pressure, wherein the second mode includes a control to continuously maintain the drive current after increasing the drive current to a maximum value in an injection period and a control to reduce the drive current from the maximum value in the injection period to a hold value and to maintain the drive current, the first mode includes a control to increase the drive current to the maximum value in the injection period and subsequently to continuously decrease the drive current to the hold value and to maintain the drive current, and the maximum value of the drive current in the injection period in the second mode is larger than the maximum value of the drive current in the injection period in the first mode.

5. The control device for the fuel injection valve according to claim 2, wherein the first mode includes a control to increase the drive current to the maximum value in the injection period and subsequently to continuously decrease the drive current to the hold value and to maintain the drive current, and the maximum value of the drive current in the injection period in the second mode is smaller than the maximum value of the drive current in the injection period in the first mode.

6. A control device configured to control a drive current that flows through a drive coil of a fuel injection valve that is configured to be electromagnetically driven, the control device comprising:

a determination unit configured to determine whether a supply fuel pressure, which is a pressure of fuel supplied to the fuel injection valve, is higher than a determination pressure at which the fuel pressure is determined abnormally high;

a first control unit configured to control the drive current in a first mode, when the determination unit determines that the supply fuel pressure is not higher than the determination pressure; and a second control unit configured to control the drive current in a second mode that facilitates maintaining of the fuel injection valve in an open state more than in the first mode, when the determination unit determines that the supply fuel pressure is higher than the determination pressure, wherein the second mode includes a control to continuously maintain the drive current after increasing the drive current to a maximum value in an injection period and a control to reduce the drive current from the maximum value in the injection period to a hold value and to maintain the drive current, the first mode includes a control to increase the drive current to the maximum value in the injection period and subsequently to continuously decrease the drive current to the hold value and to maintain the drive current, and the maximum value of the drive current in the injection period in the second mode is smaller than the maximum value of the drive current in the injection period in the first mode.

7. The control device for the fuel injection valve according to claim 2, wherein the second control unit is configured to set a period, in which the second control unit maintains the drive current continuously after increasing the drive current to the maximum value in the injection period, such that as a rotation speed of the engine, to which the fuel injection valve is mounted, becomes higher, the period becomes shorter.

8. The control device for the fuel injection valve according to claim 2, wherein the second control unit is configured to set a period, in which the second control unit maintains the drive current continuously after increasing the drive current to the maximum value in the injection period, to a period in which the fuel injection valve is stabilized in the open state.

9. The control device for the fuel injection valve according to claim 1, wherein the second control unit is configured to change the drive current in the second mode to the drive current in the first mode when the period in which the second control unit controls the drive current continuously in the second mode becomes longer than a predetermined period.

10. A control device configured to control a drive current that flows through a drive coil of a fuel injection valve that is configured to be electromagnetically driven, the control device comprising:

a determination unit configured to determine whether a supply fuel pressure, which is a pressure of fuel supplied to the fuel injection valve, is higher than a determination pressure at which the fuel pressure is determined abnormally high;

a first control unit configured to control the drive current in a first mode, when the determination unit determines that the supply fuel pressure is not higher than the determination pressure; and a second control unit configured to control the drive current in a second mode that facilitates maintaining of the fuel injection valve in an open state more than in the first mode, when the determination unit determines that the supply fuel pressure is higher than the determination pressure, wherein the second control unit is configured to change the drive current in the second mode to the drive current in the first mode when the period in which the second control unit controls the drive current continuously in the second mode becomes longer than a predetermined period.

11. The control device for the fuel injection valve according to claim 1, wherein the second control unit is configured to change the drive current in the second mode to the drive current in the first mode when the supply fuel pressure becomes equal to or lower than the determination pressure.

12. The control device for the fuel injection valve according to claim 1, wherein the first mode includes a control to apply a voltage, which is in a direction to reduce the drive current, to the drive coil, after increasing the drive current to a maximum value in an injection period, and the second mode does not include the control to apply the voltage, which is in the direction to reduce the drive current, to the drive coil, after increasing the drive current to a maximum value in an injection period.

13. A control device configured to control a drive current that flows through a drive coil of a fuel injection valve that is configured to be electromagnetically driven, the control device comprising:

a determination unit configured to determine whether a supply fuel pressure, which is a pressure of fuel supplied to the fuel injection valve, is higher than a determination pressure at which the fuel pressure is determined abnormally high;

a first control unit configured to control the drive current in a first mode, when the determination unit determines that the supply fuel pressure is not higher than the determination pressure; and a second control unit configured to control the drive current in a second mode that facilitates maintaining of the fuel injection valve in an open state more than in the first mode, when the determination unit determines that the supply fuel pressure is higher than the determination pressure, wherein the first mode includes a control to apply a voltage, which is in a direction to reduce the drive current, to the drive coil, after increasing the drive current to a maximum value in an injection period, and the second mode does not include the control to apply the voltage, which is in the direction to reduce the drive current, to the drive coil, after increasing the drive current to a maximum value in an injection period.

14. The control device for the fuel injection valve according to claim 1, wherein the determination pressure is a pressure at which the fuel injection valve is incapable of injecting fuel when the drive current is controlled in the first mode.

15. The control device for the fuel injection valve according to claim 1, wherein the determination pressure is a pressure at which the fuel injection valve is incapable of being in a fully open state when the drive current is controlled in the first mode.

16. A fuel injection system comprising:

the control device for the fuel injection valve according to claim 1;

the fuel injection valve; and a fuel pressure sensor configured to detect the supply fuel pressure.

17. The control device for the fuel injection valve according to claim 1, wherein the determination unit is configured to determine whether the supply fuel pressure is higher than the determination pressure, which does not occur in a normal state and at which the fuel pressure is determined abnormally high.

18. The control device for the fuel injection valve according to claim 1, wherein a state in which the supply fuel pressure is higher than the determination pressure occurs:

when an abnormality occurs in a fuel pump that supplies fuel to the fuel injection valve;

when fuel injection is performed after dead soak to stop an engine, which is equipped with the fuel injection valve, when the engine is at a high temperature;

when fuel injection is performed after a hybrid vehicle, which is a subject vehicle of the control device, travels by using a motor driving force of a motor; and/or when fuel injection is performed after fuel cut while a subject vehicle of the control device travels on a long downhill.

* * * * *